US012043949B2

(12) United States Patent
Kang et al.

(10) Patent No.: US 12,043,949 B2
(45) Date of Patent: Jul. 23, 2024

(54) CLOTHING TREATMENT APPARATUS

(71) Applicant: LG ELECTRONICS INC., Seoul (KR)

(72) Inventors: Hyungha Kang, Seoul (KR); Jaehyung Kim, Seoul (KR); Semin Jang, Seoul (KR); Joosik Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/225,509

(22) Filed: Jul. 24, 2023

(65) Prior Publication Data

US 2023/0366141 A1 Nov. 16, 2023

Related U.S. Application Data

(63) Continuation of application No. 16/957,785, filed as application No. PCT/KR2018/015560 on Dec. 7, 2018, now Pat. No. 11,732,399.

(30) Foreign Application Priority Data

Dec. 8, 2017 (KR) ..... 10-2017-0168508
Dec. 8, 2017 (KR) ..... 10-2017-0168509

(51) Int. Cl.
*D06F 58/10* (2006.01)
*D06F 58/20* (2006.01)
(Continued)

(52) U.S. Cl.
CPC ..... *D06F 58/10* (2013.01); *D06F 58/20* (2013.01); *D06F 58/36* (2020.02); *D06F 2105/32* (2020.02); *D06F 2105/54* (2020.02)

(58) Field of Classification Search
CPC ..... D06F 58/10; D06F 58/20; D06F 58/36; D06F 2105/32; D06F 2105/54; D06F 39/14; D06F 73/02
See application file for complete search history.

(56) References Cited

U.S. PATENT DOCUMENTS 2,540,725 A * 2/1951 Geldhof ..... D06F 58/22 55/508
2,831,268 A 4/1958 Cox
(Continued)

FOREIGN PATENT DOCUMENTS

CN 101096816 A 1/2008
CN 106049008 A 10/2016
(Continued)

OTHER PUBLICATIONS

Translation, JP-2004052386-A (Year: 2004).*
(Continued)

*Primary Examiner* — Jessica Yuen
(74) *Attorney, Agent, or Firm* — Birch, Stewart, Kolasch & Birch, LLP

(57) ABSTRACT

A clothing treatment apparatus includes a cabinet which forms a treatment space for accommodating clothing, a duct in which an inside air channel which sucks inside air from the treatment space and guides the inside air to discharge the inside air to the treatment space, and an outside air channel which sucks outside air from an outer space of the cabinet and guides the outside air to discharge the outside air to the treatment space are preset, a fan which moves air in the duct, and (i) an opening and closing module which is operated to change whether or not a through-channel including at least one of an outside air inlet channel between the outer space and the outside air channel and (ii) an exhaust outlet channel between the treatment space and the outer space is blocked.

16 Claims, 18 Drawing Sheets

(51) Int. Cl.

| | |
|---|---|
| ***D06F 58/36*** | (2020.01) |
| ***D06F 105/32*** | (2020.01) |
| ***D06F 105/54*** | (2020.01) |

(56) References Cited

U.S. PATENT DOCUMENTS

| | | | | |
|---|---|---|---|---|
| 4,262,430 | A | 4/1981 | Janson et al. | |
| 11,732,399 | B2 * | 8/2023 | Kang | D06F 58/10 62/534 |

FOREIGN PATENT DOCUMENTS

| | | | | |
|---|---|---|---|---|
| EP | 2 604 845 | A2 | | 6/2013 |
| JP | 4-84997 | A | | 3/1992 |
| JP | 6-304393 | A | | 11/1994 |
| JP | 3207737 | B2 | | 9/2001 |
| JP | 2004052386 | A | * | 2/2004 |
| JP | 2010255388 | A | * | 11/2010 |
| JP | 2013-124635 | A | | 6/2013 |
| KR | 10-2010-0121201 | A | | 11/2010 |
| KR | 10-2011-0082375 | A | | 7/2011 |
| KR | 10-2012-0015012 | A | | 2/2012 |

OTHER PUBLICATIONS

Translation, JP-2010255388-A (Year: 2010).*
European Search Report, dated Aug. 23, 2021, issued in Patent Application No. 18886174.4 (12 Pages).
PCT International Search Report, dated Mar. 28, 2019, issued in International Patent Application No. PCT/KR2018/015560 (15 pages).

* cited by examiner

CLOTHING TREATMENT APPARATUS

CROSS REFERENCE TO RELATED APPLICATIONS

This application is a Continuation of U.S. application Ser. No. 16/957,785, filed on Jun. 25, 2020, which is the National Phase under 35 U.S.C. § 371 of International Application No. PCT/KR2018/015560, filed on Dec. 7, 2018, which claims the benefit under 35 U.S.C. § 119(a) to Patent Application Nos. 10-2017-0168508 and 10-2017-0168509, both filed in the Republic of Korea on Dec. 8, 2017, all of which are hereby expressly incorporated by reference into the present application.

TECHNICAL FIELD

The present disclosure relates to a clothing treatment apparatus which supplies air to clothing.

BACKGROUND

A clothing treatment apparatus refers to all apparatuses for managing or treating clothing, such as washing or drying cloth, or removing wrinkles of clothing at home or in a laundry. For example, the clothing treatment apparatus includes a washing machine for washing clothing, a dryer for drying clothing, a washing machine/dryer having both washing and drying functions, a refresher for refreshing clothing, a steamer to remove unnecessary wrinkles of clothing, or the like.

More specifically, the refresher is an apparatus for making clothing more pleasant and fresh, and performs functions such as drying clothing, supplying fragrance to clothing, preventing occurrence of static electricity in clothing, and removing wrinkles of clothing. In general, the steamer is an apparatus which removes wrinkles of clothing by supplying steam to clothing, and unlike a typical iron, in the steamer, clothing does not come into contact with a heating plate, and thus, it is possible to delicately removes wrinkles of the clothing. A clothing treatment apparatus is known, which has functions of the refresher and the steamer together and performs functions such as removing wrinkles and odors of clothing stored therein by using steam and hot air.

In addition, an apparatus is known, which includes a hanger rod for hanging clothing in a treatment chamber to provide steam into the treatment chamber in a state the clothing is suspended or to circulate air in the treatment chamber and supplies hot air.

Technical Problem

In the prior art, there is a problem that a possibility of exerting more various functions by a combination of functions of parts and various air channels is limited. A first object of the present disclosure is to solve the above-described problem.

A second object of the present disclosure is to supply outside air to clothing as needed so that a clothing treatment apparatus can exhibit more various functions.

A third object of the present disclosure is to provide an efficient structure to control a change of a channel.

A fourth object of the present disclosure is to provide a structure for opening and closing of outside air flow in which control and operation performance are efficient.

A fifth object of the present disclosure is to minimize a resistance to outside air flow, form a clean appearance, and improve usability of a door from a point of view of a user while achieving the above-described objects.

Technical Solution

In order to achieve the above-described object, according to an aspect of the present disclosure, there is provided a clothing treatment apparatus including: a cabinet which forms a treatment space for accommodating clothing; a duct in which an inside air channel which sucks inside air from the treatment space and guides the inside air to discharge the inside air to the treatment space, and an outside air channel which sucks outside air from an outer space of the cabinet and guides the outside air to discharge the outside air to the treatment space are preset; a fan which moves air in the duct; and (i) an opening/closing module which is operated to change whether or not a through-channel including at least one of an outside air inlet channel between the outer space and the outside air channel and (ii) an exhaust outlet channel between the treatment space and the outer space is blocked.

The opening/closing module includes an outside air opening/closing module which is operated to change whether or not the outside air inlet channel is blocked, and an exhaust opening/closing module which is operated to change whether or not the exhaust outlet channel is blocked.

The cabinet includes a door through which the clothing is put into the treatment space, and the opening/closing module is disposed in the door.

The through-channel includes an outer opening portion which is disposed in one region of a side surface portion of the door in a state where the through-channel is open and faces the outer space.

The door is rotatably provided about a predetermined hinge axis disposed on a side opposite to the one region of both sides, the opening/closing module includes an exposure blocking portion which is disposed in place of the outer opening portion in the one region in a state where the through-channel is closed, and the exposure blocking portion forms a groove which is recessed and extends to be parallel to the hinge axis.

The side surface portion of the door forms a groove which is recessed and extends in a direction parallel to the hinge axis, and the groove of the exposure blocking portion is disposed on an extension line of the groove of the door in the state where the through-channel is closed.

The cabinet includes a door through which the clothing is put into the treatment space, the opening/closing module includes an outside air opening/closing module which is operated to change whether or not the outside air inlet channel is blocked and is disposed in the door, and a downstream end of the outside air inlet channel and an upstream end of the outside air channel are connected to each other in a state where the door is closed and the outside air inlet channel is open.

A recessed groove is formed on a side surface portion of the cabinet, and an outer opening portion facing the outer space of the through-hole in a state where the through-channel is open is disposed in the groove of the side surface portion of the cabinet.

The clothing treatment apparatus further includes: a valve module which is operated to change whether or not the inside air channel is blocked; and a controller which selects any one of a plurality of modes including a preset circulation mode and ventilation mode, performs a control so that the valve module opens the inside air channel and the opening/closing module blocks the through-channel in the circulation mode, and performs a control so that the valve module blocks the inside air channel and the opening/closing module opens the through-channel in the ventilation mode.

The duct forms a shared section constituting a portion of the inside air channel and a portion of the outside air channel, the fan is disposed in the shared section, and the valve module is provided at a position where the outside air channel is not blocked when the inside air channel is blocked.

The opening/closing module includes a louver member which is rotatably provided about a predetermined louver rotation axis and is operated to change whether or not the through-channel is blocked, a moving member which operates the louver member while moving along a predetermined moving direction which is a direction across the louver rotation axis, and a drive assembly which include a motor for generating a drive force and converts the drive force to move the moving member in the moving direction.

A transmission protrusion protruding at a position spaced apart from the louver rotation axis is formed in one of the louver member and the moving member, a transmission recess into which the transmission protrusion is inserted is formed in the other of the louver member and the moving member, and the transmission recess is formed to be longer than the transmission protrusion in a direction across the louver rotation axis and the moving direction.

The louver member includes a blocking portion which forms at least a portion of the through-channel, a louver base which supports the blocking portion, and a louver shaft portion which is disposed on the louver rotation axis of the louver base.

A pair of through-channels spaced apart from each other is provided, a pair of louver members corresponding to the pair of through-channels is provided, a pair of moving members corresponding to the pair of louver members is provided, the drive assembly is provided to transmit a drive force of a motor to the pair of moving members, and the moving directions of the pair of moving members are preset to be opposite to each other.

the drive assembly includes a main drive member which comes into contact with the moving member to move the moving member in the moving direction; and a power transmission unit having at least one gear which transmits the drive force of the motor to the main drive member to rotate the main drive member.

The main drive member is rotatably provided about a predetermined main drive rotation axis extending in a direction across the moving direction and forms a cam groove which extends to be away from the main drive rotation axis as the cam groove goes in any one of a clockwise direction and a counterclockwise direction about the main drive rotation axis, and the moving member includes a cam protrusion which is inserted into the cam groove.

A pair of louver members spaced apart from each other is provided, a pair of moving members corresponding to the pair of louver members is provided, and the main drive member forms a pair of cam grooves corresponding to the pair of moving members.

The drive assembly includes a main drive member which pushes the moving member in the moving direction when moving a predetermined main drive direction across the moving direction.

The main drive member includes a pressing portion which faces a direction between the main drive direction and the moving direction and forms an inclined surface which is in contact with the moving member, and the moving member includes a sliding portion which is in contact with the inclined surface and is slidably provided along the inclined surface.

A pair of louver members spaced apart from each other is provided, pair of moving members corresponding to the pair of louver members is provided, the main drive member forms a pair of pressing portions corresponding to the pair of moving members, and the pair of moving members are provided to be away from each other when the main drive member moves in the main drive direction.

A pair of louver members spaced apart from each other is provided, a pair of moving members corresponding to the pair of louver members is provided, moving directions of the pair of moving members are preset to be opposite to each other, and the main drive member includes a top portion which is inserted into a portion between the pair of moving members in a state where the top portion moves as far as possible in a direction opposite to the main drive direction.

The pair of moving members includes a first moving member and second moving member, the main drive member includes a first inclined surface which is away from the top portion in the direction opposite to the main drive direction as the first inclined surface goes in a moving direction of the first moving member in the top portion, and a second inclined surface which is away from the top portion in the direction opposite to the main drive direction as the second inclined surface goes in a moving direction of the second moving member in the top portion.

The drive assembly includes an elastic member which is elastically deformed when the moving member moves in the moving direction and is elastically restored when the moving member moves in the direction opposite to the moving direction.

The drive assembly includes a screw gear which is rotated about a rotation axis parallel to the main drive direction by the drive force of the motor, and the main drive member forms a screw groove which meshes with the screw gear.

Advantageous Effects

The channel can be switched, and thus, the clothing treatment apparatus can perform more various and variable functions.

Moreover, the outside air channel is provided, and thus, clean air can be supplied to the clothing. In addition, the outside air channel is selectively provided, and thus, it is possible to consider an effect on the air around the clothing treatment apparatus.

The downstream end of the outside air inlet channel and the upstream end of the outside air channel are provided to be connected to each other, and thus, outside air can flow into the outside air channel through the outside air inlet channel.

Furthermore, the upstream end of the outside air channel is provided to be exposed to the outside in the state where the door is open, and thus, it is possible to easily clean the upstream end of the outside air channel and a rear surface of the outside air blocking module.

The outer opening portion in the state where the through-channel is open is disposed on the side surface portion where the groove of the cabinet is formed, and thus, when the user view the clothing treatment apparatus from the front, the outer opening portion is visually covered to form a neat appearance. In addition, the side surface portion of the cabinet may be covered by other objects (different furniture or walls, or the like). However, even if the side surface portion of the cabinet is covered by other objects, the outside air sucked through the space formed by the groove or the air exhausted through the space can flow smoothly.

If the outer opening portion is disposed in the front direction, air may be blown in the front direction to cause discomfort to a user and apparently to cause discomfort. In addition, if the outer opening portion is formed in an upper direction, dust accumulated on an upper surface of the clothing treatment apparatus may be blown or sucked into the cabinet, which may cause problems. In addition, if the outer opening portion is formed in a rear or side direction of a main body (a portion of the cabinet which is not the door), the suction of the outside air and/or the discharge of air is interrupted by other objects (such as other furniture or walls) disposed on the side and rear. The side surface portion of the door is a portion which is exposed when the user opens the door. Meanwhile, the outer opening portion is disposed in one region of the side surface portion of the door in a state where the through-channel is open and faces the outer space in a lateral direction. Accordingly, a possibility that the suction of the outside air and/or the discharge of air is interrupted by other objects is minimized, the user can directly solve a problem caused by the air blowing, and it is possible to prevent the dust accumulated on the upper surface from being sucked/blown.

The exposure blocking portion forms the groove which is recessed and extends to be parallel to the hinge axis. Accordingly, the user holds a hand in the groove of the exposure blocking portion in a state where the through-channel is closed, and thus, the user can easily open or close the door. That is, the exposure blocking portion can implement an efficient structure capable of blocking the through-channel and simultaneously performing the handle function of the door.

The side surface portion of the door forms the groove extending in the direction parallel to the hinge axis, the groove of the exposure blocking portion is disposed on the extension line of the groove of the door. Accordingly, the user can hold the groove of the side surface portion of the door by the hand of the user or the groove of the exposure blocking portion by the hand of the user to open or close the door, and can hold a boundary point between the groove of the side surface portion of the door and the groove of the exposure blocking portion by the hand of the user to open or close the door without inconvenience.

According to a structure of the opening/closing module, it is possible to easily operate and control the pair of louver members by one motor. According to structures of the main drive member and the moving member, it is possible to easily open or close the through-channels spaced apart from each other.

According to the transmission protrusion and the transmission recess, the moving can rotate the louver member while the moving member linearly moves in a state where bending of the moving member is minimum.

The moving member and the pressing portion are provided, and thus, it is possible to provide desired power to the louver member away from the drive assembly. In addition, it is possible to move the pair of moving members in directions different from each other by a movement of one main drive member.

When the main drive member in the main drive direction, the pair of moving members is provided to be away from each other. Accordingly, the main drive member can cancel reaction forces of the pair of moving members applied in a direction perpendicular to the main drive direction while the main drive member is inserted into between the pair of moving members and moves.

The moving member is guide to slide in a state where the moving member is in close contact with the main drive member due to the elastic member, and thus, the main drive member can guide the moving member along a correction position. Moreover, the moving member can move to be easily returned in the direction opposite to the moving direction due to the elastic member.

The top portion is inserted into between the pair of moving members. Accordingly, when the main drive member moves in the main drive direction, the pair of moving members can smoothly move to be away from each other without jamming.

BRIEF DESCRIPTION OF DRAWINGS

FIG. 8 illustrates a state where the through-channel 127 is blocked, and FIG. 9 illustrates a state where the through-channel 127 is open.

FIG. 13*a* illustrates a state where the pair of moving members 150*a* and 150*b* (150*a*' and 150*b*) is completed to move as far as possible in a direction Mr1 opposite to the moving direction, and FIG. 13*b* illustrates a state where the pair of moving members 150*a* and 150*b* (150*a*' and 150*b*) is completed to move as far as possible in a moving direction Mp1.

FIG. 15*a* illustrates a state where the pair of moving members 150*a*' and 150*b* is completed to move as far as possible in the direction Mr1 opposite to the moving direction, and FIG. 15*b* illustrates a state where the pair of moving members 150*a*' and 150*b* is completed to move as far as possible in the moving direction Mp1.

FIG. 16*a* illustrates a state where the moving members 150 and 150' are completed to move as far as possible in the direction Mr1 opposite to the moving direction, and FIG. 16*b* illustrates a state where the moving members 150 and 150' are completed to move as far as possible in the moving direction Mp1.

DETAILED DESCRIPTION

Figure 1:
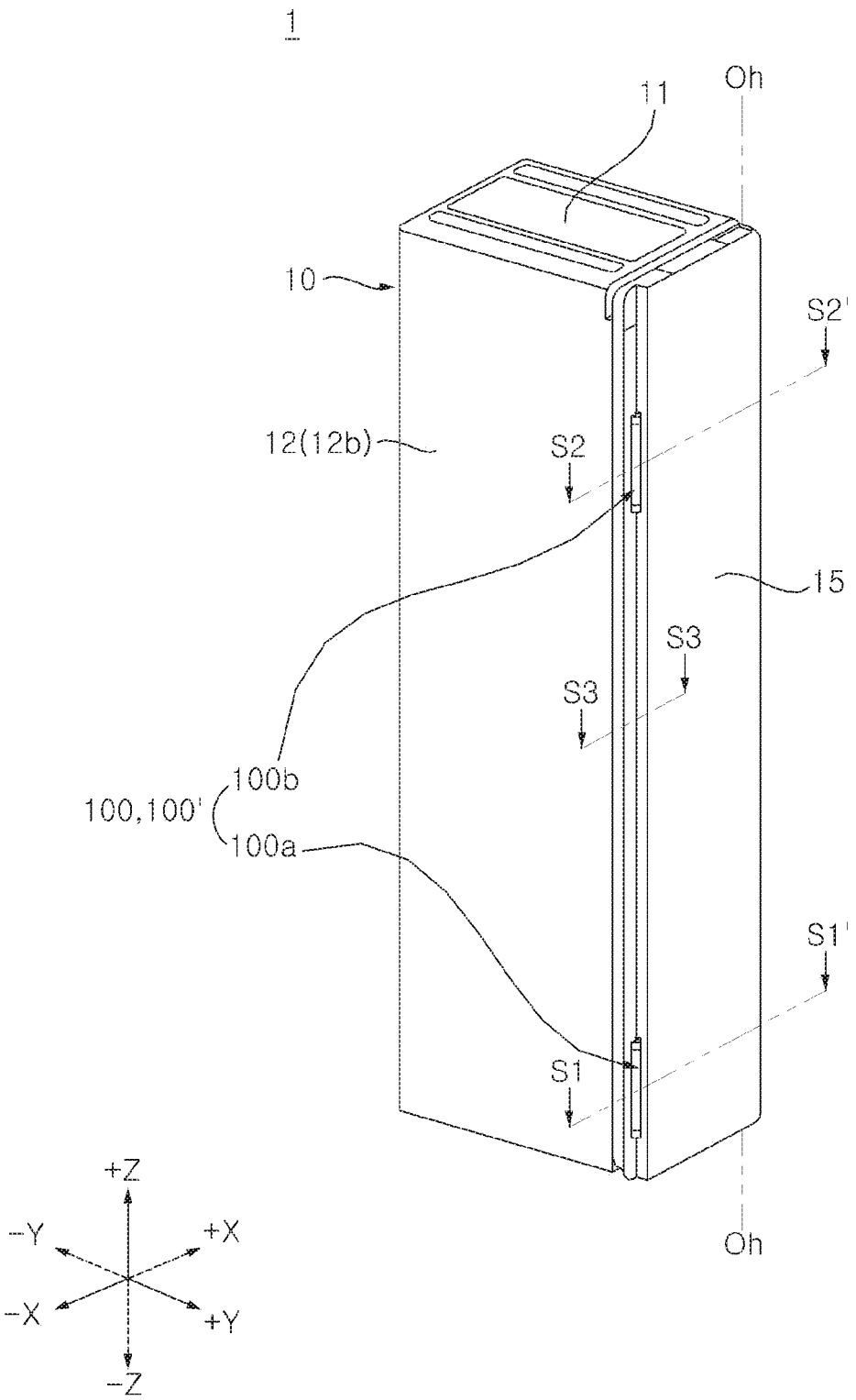
FIG. 1 is a perspective view of a clothing treatment apparatus 1 according to an embodiment of the present disclosure.

In order to explain the present disclosure, the following description will be made based on a spatial orthogonal coordinate system by an X-axis, a Y-axis and a Z-axis orthogonal to each other. Each axial direction (X-axis direction, Y-axis direction, Z-axis direction) means both directions in which each axis extends. A "+" sign (+X-axis direction, +Y-axis direction, +Z-axis direction) in front of each axial direction means a positive direction, which is one of both directions in which each axis extends. A "−" sign (−X-axis direction, −Y-axis direction, −Z-axis direction) in front of each axial direction means a negative direction, which is the other of both directions in which each axis extends.

The expressions referring to directions such as "before (+Y)/after (−Y)/left (+X)/right (−X)/up (+Z)/down (−Z)" mentioned below are defined according to an XYZ coordinate axis. However, the expressions are only to explain the present disclosure to be clearly understood, and it is needless to say that each direction may be defined differently depending on where a reference is placed.

An "upstream side" and a "downstream side" described in the present disclosure are defined based on a preset flow direction of air.

The use of terms such as "first, second, and third" in front of the components mentioned below is only to avoid confusion of referred components, and is irrelevant to an order, an importance, or a master/slave relationship between the components. For example, an embodiment including only a second component without a first component can be implemented.

A "hinge axis Oh, a louver rotation axis Os, a first louver rotation axis Os1, a second louver rotation axis Os2, a main drive rotation axis Oa and a transmission rotation axis Ob" mentioned in the present disclosure are virtual axes for explaining the present disclosure, not actual parts of an apparatus.

As used herein, a singular expression includes a plural expression unless a context clearly indicates otherwise.

A clothing treatment apparatus 1 according to an embodiment of the present disclosure includes a cabinet 10 placed on an external floor or fixed to an external wall. The cabinet 10 forms a treatment space 10*s* for accommodating clothing. The clothing treatment apparatus 1 may include a hanger module 30 provided to hang a clothing or hanger within the treatment space 10*s*. The clothing treatment apparatus 1 includes a duct 40 in which an air channel for supplying air to the clothing is preset. The clothing treatment apparatus 1 includes a fan 50 which moves air in the duct 40. The clothing treatment apparatus 1 may include a heat exchange module 60 for heating or cooling air passing through the heat exchange module 60. The clothing treatment apparatus 1 may include a filter module 90 having a filter unit 95 for filtering dust in the air passing through the clothing treatment apparatus 1.

A plurality of channels may be preset in the duct 40. Any one of the plurality of channels is provided to be selectable. The plurality of channels includes an outside air channel Pc. The plurality of channels may include inside air channels Pa and Pb. In the duct 40, the outside air channel Pc which guides outside air so that the outside air is sucked from an outer space Ou of the cabinet 10 and is discharged to the treatment space 10*s* is preset. In the duct 40, the inside air channels Pa and Pb which guides inside air so that the inside air is sucked from the treatment space 10*s* and is discharged to the treatment space 10*s* may be preset.

The clothing treatment apparatus 1 may include a valve module 70 which is operated to change whether or not the inside air channels Pa and Pb are blocked. The clothing treatment apparatus 1 includes opening/closing modules 100 and 100' which are operated to change whether or not inflow of the outside air and/or outflow of exhaust air are blocked.

The clothing treatment apparatus 1 includes a controller 2 which controls various parts. The controller 2 perform a control so that one of the plurality of channels is selected.

Figure 2:
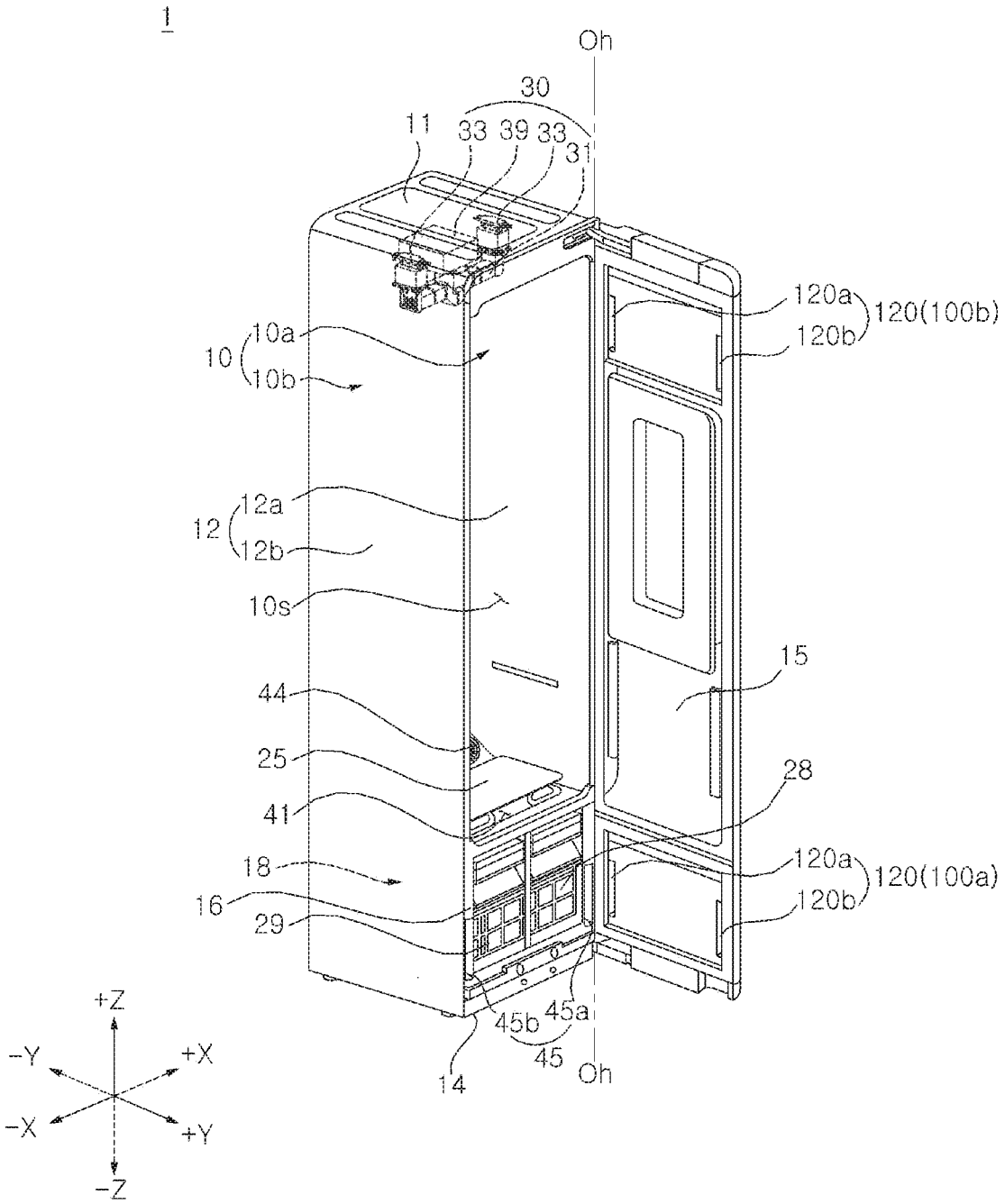
FIG. 2 is a perspective view of the clothing treatment apparatus 1 of FIG. 1 in a state where the door 15 is open.
Figure 3:
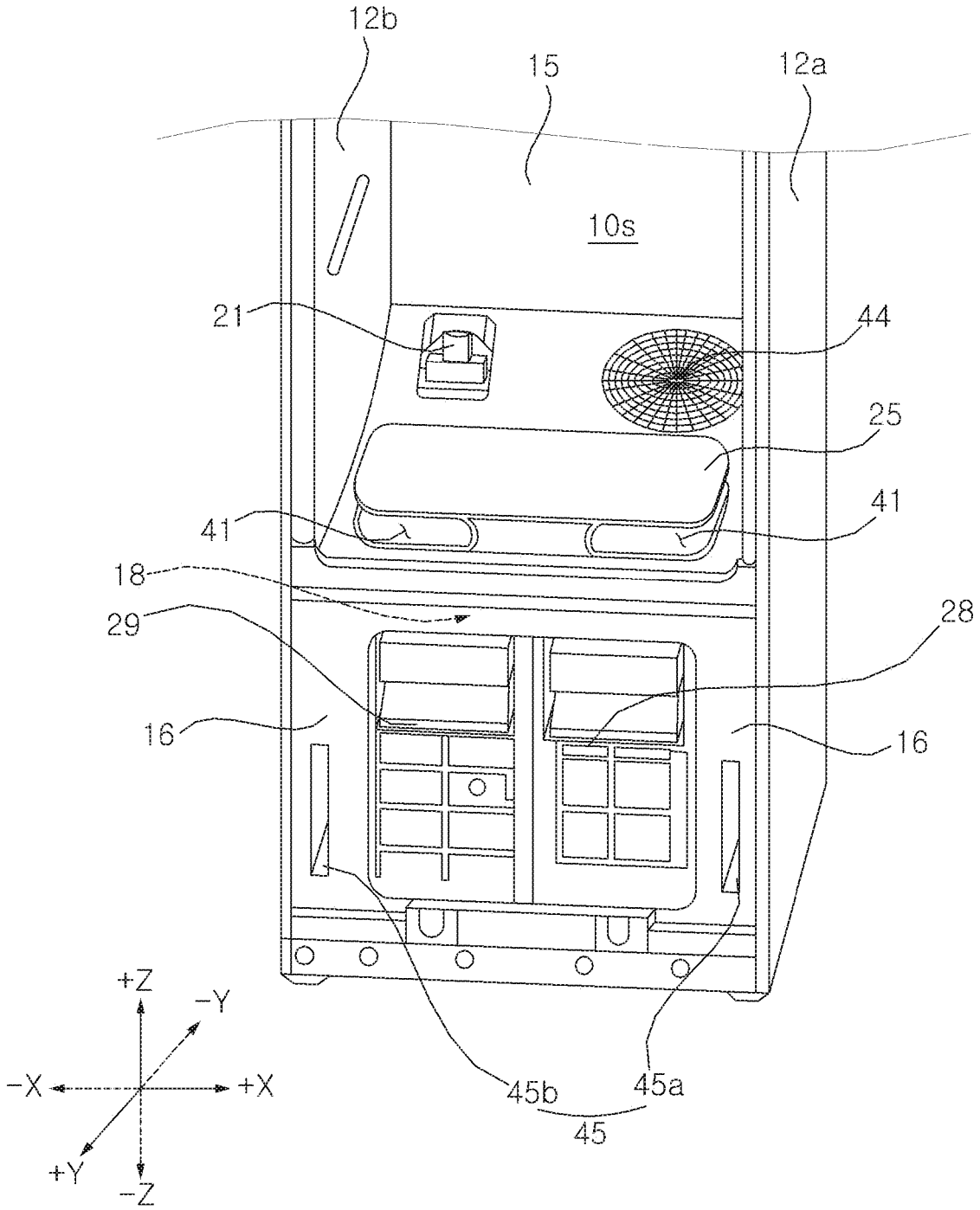
FIG. 3 is a partial perspective view in which a portion of a treatment space 10*s* of the clothing treatment apparatus 1 of FIG. 2 is viewed.

Referring to FIGS. 1 to 3, the cabinet 10 forms an appearance. The cabinet 10 includes a top panel 11 forming an upper surface, side panels 12 forming right and left side surfaces, and a rear panel 13 forming a rear surface. The cabinet 10 includes a base 14 which forms a bottom surface. The side panels 12 may include a first side panel 12*a* forming the left surface and a second side panel 12*b* forming the right surface.

The cabinet 10 includes an inner cabinet 10*a* forming an inner surface. The cabinet 10 includes an outer cabinet 10*b* forming an outer surface.

The cabinet 10 includes a door 15 for putting clothing into the treatment space 10*s*. The door 15 may open and close an open surface of the treatment space 10*s*. The treatment space 10*s* is isolated from the outside in a state where the door 15 is closed. The treatment space 10*s* is exposed to the outside in a state where the door 15 is open.

Portions of the cabinet 10 other than the door 15 may be referred to as main bodies 11, 12, 13, and 14. The main bodies 11, 12, 13, and 14 include the top panel 11, the side panels 12, the rear panel 13, and the base 14.

The door 15 is rotatably provided about the predetermined hinge axis Oh. The door 15 is provided so that the other side rotates about hinge axis Oh disposed on one side to open or close the treatment space 10*s*. The door 15 may be rotatably provided about a hinge axis Oh disposed on a side opposite to a region in which an outer opening portion 127*a*, which will be described later, is disposed on both sides +X and −X. In the present embodiment, the outer opening portion 127*a* is disposed on both sides of the door 15. In this case, the hinge axis Oh may be disposed on a side opposite to any one (outer opening portion 127*a* of louver member 120*b*) of both outer opening portions 127*a*. The hinge axis Oh may extend in an up-down direction.

In order to provide a function of the hinge axis Oh, for example, a separate part having a function as a shaft may be disposed to connect the door 15 and the main bodies 11, 12, 13, and 14 to each other, or as another example, a protrusion protruding along the hinge axis Oh is formed in any one of the door 15 and the main bodies 11, 12, 13, and 14 may be formed, and a groove into which the protrusion is rotatably inserted may be formed in the other thereof.

The inner cabinet 10*a* and an inner surface of the door 15 define treatment spaces 10*s*. In a state where the door 15 is closed, the inner cabinet 10*a* and a door inner frame 15*a* define a treatment space 10*s*. In the treatment space 10*s*, physical or chemical properties of the clothing by applying air (for example, hot air), steam, fragrance, and/or an antistatic agent to the clothing are changed. A treatment may be performed on clothing in various ways in the treatment space 10*s*.

For example, the clothing may be dried by applying hot air to the clothing in the treatment space 10*s*. Steam may be supplied to the clothing in the treatment space 10*s* to unfold wrinkles in the clothing. Air and/or steam supplied into the treatment space 10*s* affects the physical or chemical properties of the clothing accommodated in the treatment space 10*s*. A tissue structure of the clothing is relaxed by hot air or steam, and wrinkles are spread, and unpleasant odor can be removed by reacting the odor molecules bare in the clothing with steam. In addition, hot air and/or steam can sterilize germs parasitic on clothing.

For example, dust in clothing in the treatment space 10*s* can be removed through circulation and filtering of air. In addition, by supplying air outside the cabinet 10 to the clothing, the clothing in the treatment space 10*s* can be dehumidified or the smell of clothing can be removed. In addition, it is possible to treat the clothing so that a fragrance can be generated from the clothing by spraying the fragrance to the clothing in the treatment space 10*s*, or it is possible to prevent the static electricity from being generated in the clothing by spraying an antistatic agent to the clothing.

The cabinet 10 includes a machine room 18 for treating air supplied into the treatment space 10*s*. The machine room 18 is formed in the main bodies 11, 12, 13, and 14. The machine room 18 may be disposed under the treatment space 10*s*.

The duct 40 may be disposed in the machine room 18. The fan 50 and the heat exchange module 60 may be disposed in the machine room 18. The valve module 70 may be disposed in the machine room 18. The filter module 90 may be disposed in the machine room 18. The filter module 90 can be disposed to be withdrawable from within the machine room 18. In a state where the filter module 90 is disposed in the machine room 18, a cover 25 covering the filter module 90 may be disposed. In addition, an auxiliary filter (not illustrated) disposed removably between the cover 25 and the filter module 90 may be provided.

The main bodies 11, 12, 13, and 14 may form a door facing surface 16 facing the door in the state where the door 15 is closed. The door facing surface 16 may be disposed in a front portion of the machine room 18. The door facing surface 16 may be disposed facing the same direction as an opening portion of the treatment space 10*s*. The door facing surface 16 may be disposed below the treatment space 10*s*. The door 15 may cover the door facing surface 16 in the state where the door 15 is closed. The door facing surface 16 may come into contact with the door 15 in the state where the door is closed.

Front surfaces of a condensate storage unit 28 and the supply water storage unit 29 may be disposed on the door facing surface 16. The door 15 may cover the condensate storage unit 28 and the supply water storage unit 29 in the state where the door is closed.

An upstream end 45 of the outside air channel Pc may be disposed on the door facing surface 16. The upstream end 45 of the outside air channel Pc may be referred to as an outside air connector 45. The door 15 may cover the outside air connector 45 in the state where the door 15 is closed. The outside air connector 45 may be disposed to face the door in the state where the door 15 is closed. The outdoor air connector 45 may be provided to be exposed to the outside in the state where the door 15 is open.

Figure 5:
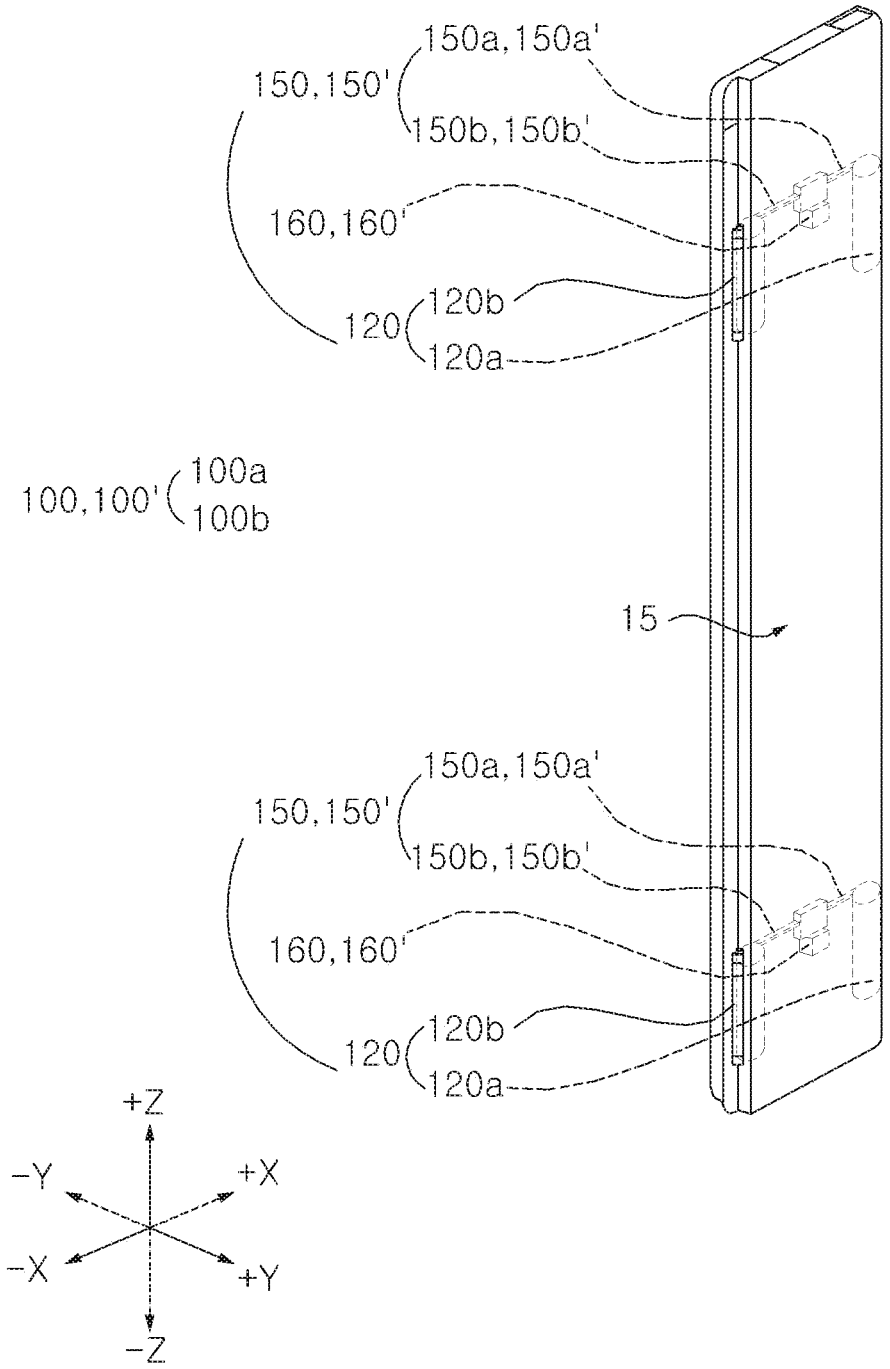
FIG. 5 is a perspective view of a door 15 and opening/closing modules 100 and 100' of FIG. 1.
Figure 7:
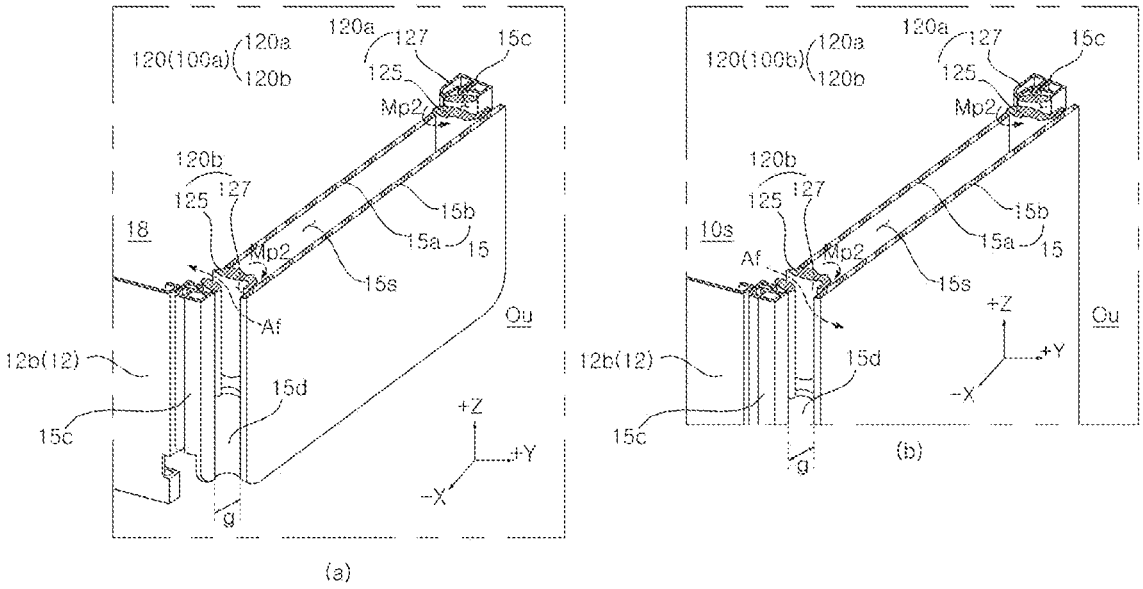
FIG. 7 is a view illustrating a state where the through-channel 127 is open, FIG. 7(*a*) is a cross-sectional perspective view when the clothing treatment apparatus 1 of FIG. 1 is horizontally taken along line S1-S1', and FIG. 7(*b*) is a cross-sectional perspective view when the clothing treatment apparatus 1 of FIG. 1 is horizontally taken along line S2-S2'.

Referring to FIGS. 5, 7(*a*), and 9, when the outside air opening/closing module 100*a* to be described later is disposed in the door 15, in the state where the door 15 is closed and in the state where the outside air inlet channel 127 to be described later is open, the downstream end 127*b* of the outside air inlet channel 127 and the upstream end 45 of the outside air channel Pc may be provided to be connected to each other. Accordingly, the outside air of the outer space Ou may be introduced into the outside air channel Pc through the outside air inlet channel 127.

Referring to FIGS. 6 to 10, the door 15 may include the door inner frame 15*a* forming a surface facing the treatment space 10*s* in the state where the door 15 is closed. The door 15 may include a door outer frame 15*b* forming the front surface of the door 15 in the state where the door 15 is closed. The door outer frame 15*b* is disposed to face the outer space Ou. The door 15 may include a door side frame 15*c* formed along an edge of the door 15. A gasket is disposed on the door side frame 15*c* to prevent a gap between the door 15 and the main bodies 11, 12, 13, and 14 in the state where the door 15 is closed. The door side frame 15*c* may be fixed to the door inner frame 15*a*.

Referring to FIGS. 5 to 10, a predetermined gap g may be formed between the door inner frame 15*a* and the door outer frame 15*b*. The door side frame 15*c* may be disposed so as not to cover the gap g. The door 15 may include a door side surface portion 15*d* forming at least a portion of the side surface of the door 15. The door side surface portion 15*d* may be disposed to block the gap between the door outer frame 15*b* and the door inner frame 15*a*. The door side surface portion 15*d* may be disposed to close the gap g. The door side surface portions 15*d* may be disposed on both sides of the door 15. Of both sides of the door 15, the door side surface portion 15*d* is formed on a side opposite to one side on which at least the hinge axis Oh is disposed. The door side surface portion 15*d* may be recessed to form a groove extending in a direction parallel to the hinge axis Oh. The groove of the door side surface portion 15*d* may extend vertically. The groove of the door side surface portion 15*d* exerts a handle function which allows a user to hold the door 15 by a hand of the user to open or close the door 15. The door 15 forms a door inner space 15*s* between the door inner frame 15*a* and the door outer frame 15*b*. The door side surface portion 15*d* may be disposed between the outer space Ou and the door inner space 15*s*. The drive assemblies 160 and 160' and the moving members 150 and 150' of the opening/closing modules 100 and 100' may be disposed in the door inner space 15*s*.

Referring to FIG. 2, the hanger module 30 may be disposed in an upper portion of the treatment space 10*s*. The hanger module 30 is supported by the cabinet 10. The hanger module 30 may be provided to be movable.

The hanger module 30 includes a hanger body 31 provided to hang the clothing or the hanger. For example, the hanger body 31 may form a locking groove (not illustrated) so that the hanger is hung. As another example, the hanger body 31 may include a hook (not illustrated) or the like to directly hang the clothing.

The hanger body 31 may be connected to the cabinet 10 through a hanger movable portion 33. The hanger body 31 may be provided to be vibrated in predetermined vibration directions +X and −X. The hanger body 31 may be formed to extend long in the vibration directions +X and −X. A plurality of locking grooves (not illustrated) spaced apart from each other in the vibration directions +X and −X may be disposed on an upper surface of the hanger body 31. The locking grooves may be formed to extend in directions +Y and −Y across vibration directions +X and −X.

The hanger module 30 includes the hanger movable portion 33 which movably supports the hanger body 31. The hanger movable portion 33 is formed to be movable in the vibration directions +X and −X. The hanger movable portion 33 may be formed of a flexible material so that the hanger body 31 can move. The hanger movable portion 33 may include an elastic member which is elastically deformable when the hanger body 31 moves. An upper end of the hanger movable portion 33 is fixed to the cabinet 10 and a lower end thereof is fixed to the hanger body 31. The hanger movable portion 33 may extend vertically.

The hanger module 30 may include a vibration unit 39 which generates vibrations. The vibration unit 39 is connected to the hanger body 31 and transmits the vibrations of the vibration unit 39 to the hanger body 31. The vibration unit 39 may be disposed above the hanger body 31. For example, the hanger body 31 forms a slit (not illustrated) extending in the directions +Y and −Y orthogonal to the vibration directions +X and −X, and the vibration unit 39 protrudes downward and may include a protrusion portion (not illustrated) inserted into the slit. The protrusion portion of the vibration unit 39 moves relative to the slit in the orthogonal directions +Y and −Y in a state where the protrusion portion of the vibration unit 39 is inserted into the slit of the hanger body 31, and thus, only an excitation force in the vibration directions +X and −X can be transmitted to the hanger body 31.

Figure 11A:
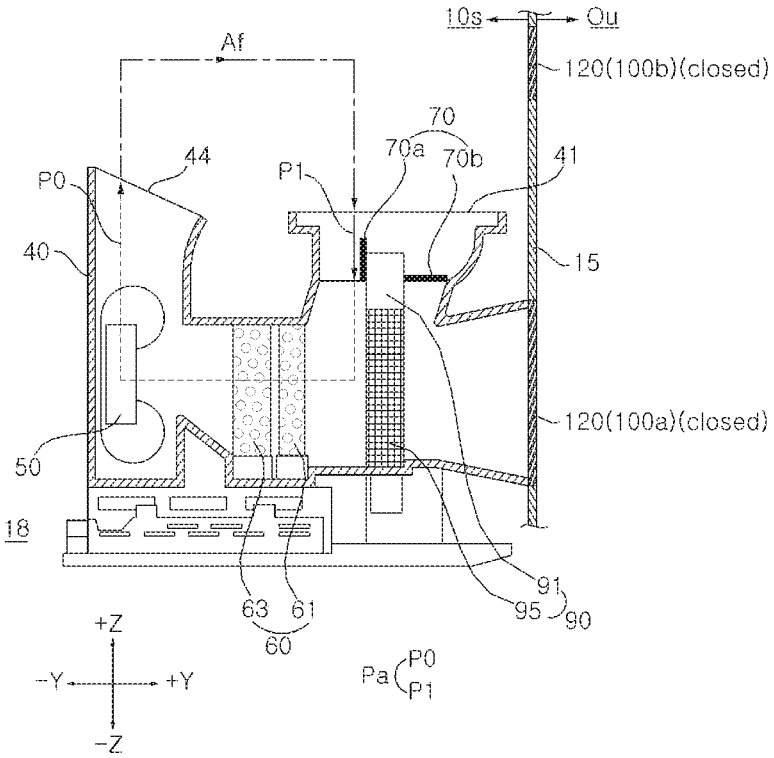
FIGS. 11*a* to 11*c* are views illustrating a change mechanism of an air channel according to operations of the opening/closing module 100 and 100' and the valve module 70 and illustrates cross-sectional conceptual views in which a duct 40 and a door 15 are cut vertically, FIG. 11(*a*) illustrates a state where a first inside air channel Pa is selected, FIG. 11(*b*) illustrates a state where a second inside air channel Pb is selected, and FIG. 11(*c*) illustrates a state where an outside air channel Pc is selected.
Figure 11B:
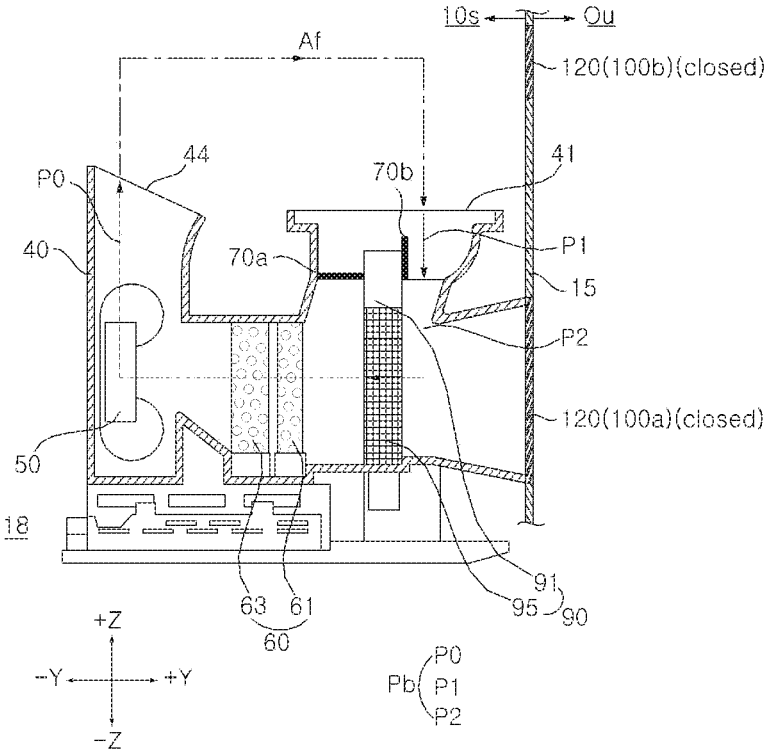
Figure 11C:
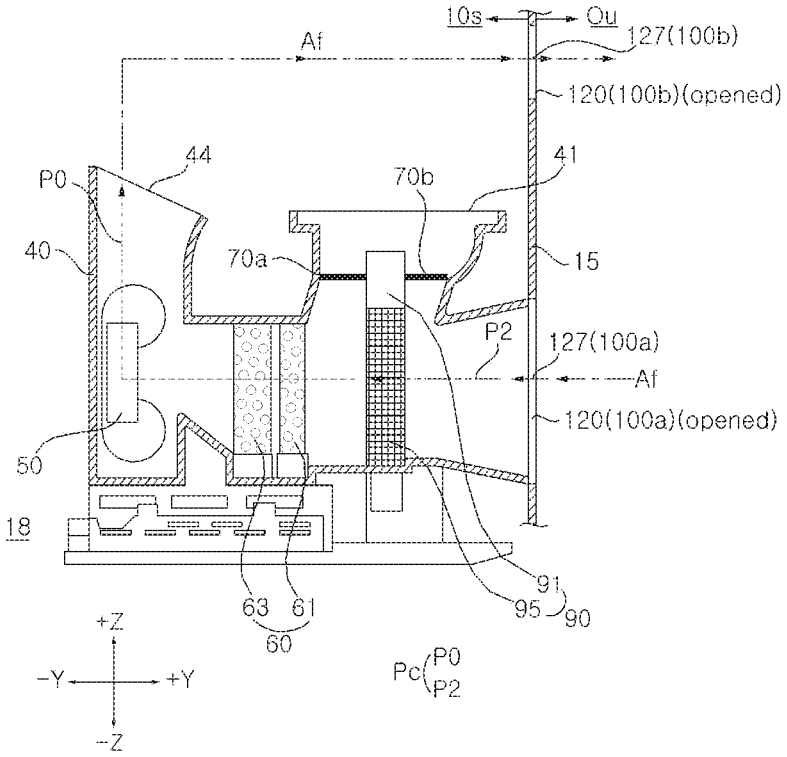

Hereinafter, referring FIGS. 11*a* to 11*c*, the duct 40 in which a plurality of channels are preset will be described in detail as follows. FIGS. 11A to 11C illustrate arrows indicating an air flow direction Af, and different types of arrows are illustrated for each section.

Air can be supplied into the treatment space 10*s* through the duct 40. Inside air can circulate and be supplied to the treatment space 10*s* through the duct 40. The inside air in the treatment space 10*s* is sucked and discharged to the treatment space 10*s* through the duct 40. The outside air of the outer space Ou can be supplied into the treatment space 10*s* through the duct 40. When the outside air is supplied into the treatment space 10*s*, air in the treatment space 10*s* may be discharged to the outer space Ou. The air discharged to the outer space Ou may be referred to as exhaust air.

The air moving through the duct 40 may be supplied into the treatment space 10*s* through a predetermined treatment process. For example, air heated by the heat exchange module 60 may be supplied into the treatment space 10*s*. Air dehumidified by the heat exchange module 60 can be supplied into the treatment space 10*s*. Air cooled by the heat exchange module 60 may be supplied into the treatment space 10*s*. In addition, air which is not separately treated may be supplied into the treatment space 10*s*. Air to which fragrance or an antistatic agent is added may be supplied into the treatment space 10*s* through the duct 40.

The duct 40 may partition the plurality of channels. One of the plurality of channels preset in the duct 40 may be provided to be selected. In the present embodiment, FIGS. 11*a*, 11*b*, and 11*c* illustrate a state in which any one of a plurality of channels Pa, Pb, and Pc is selected. However, the present disclosure is not limited thereto, and the plurality of channels may be preset to two or may be preset to four or more. One selected channel of the plurality of channels can be changed to the other selected channel by the opening/closing modules 100 and 100' and the valve module 70.

The plurality of channels may be classified according to whether the outside air flows in or out. Referring to FIGS. 11*a* and 11*b*, the plurality of channels may include at least one inside air channel Pa, Pb for guiding air sucked from the inside of the treatment space 10*s*. Referring to FIG. 11*c*, the plurality of channels may include at least one outside air channel Pc for guiding air sucked from the outer space Ou of the cabinet 10.

The plurality of channels may be classified according to whether air passes through the filter unit 95 or not. Referring to FIG. 11*a*, the plurality of channels may include at least one first inside air channel Pa which guides the air to bypass the filter unit 95. Referring to 11*b* and 11*c*, the plurality of channels may include at least one second inside air channel Pb or outside air channel Pc which guides the air to pass through the filter unit 95. Here, whether or not to pass through the filter unit 95 is defined based on any one filter unit 95, and whether or not to pass through a separate filter unit (for example, auxiliary filter) additionally provided is irrelevant. That is, the air bypassing the filter unit 95 does not mean excluding air passing through the separate auxiliary filter.

Referring to FIG. 11*a*, at least one of the inside air channels Pa and Pb may include the first inside air channel Pa for guiding air to bypass the filter unit 95. Referring to FIG. 11*b*, at least one of the inside air channels Pa and Pb may include the second inside air channel Pb for guiding air to pass through the filter unit 95. Referring to FIG. 11*c*, the outside air channel Pc may be provided to guide air to pass through the filter unit 95.

Referring to FIGS. 11*a* to 11*c*, each section constituting a portion of the air channel will be described as follows. The duct 40 may form a shared section P0 constituting a portion of the inside air channels Pa and Pb and a portion of the outside air channel Pc. The shared section P0 may configure to include a portion of the first inside air channel Pa and a portion of the filtering channels Pa and Pc in common. The shared section P0 can guide the air so that the air flows out to the treatment space 10*s*. The duct 40 may include an inside air inflow section P1 into which the air in the treatment space 10*s* flows. The duct 40 may include a filter passage section P2 for guiding air through the filter unit 95.

Figure 9:
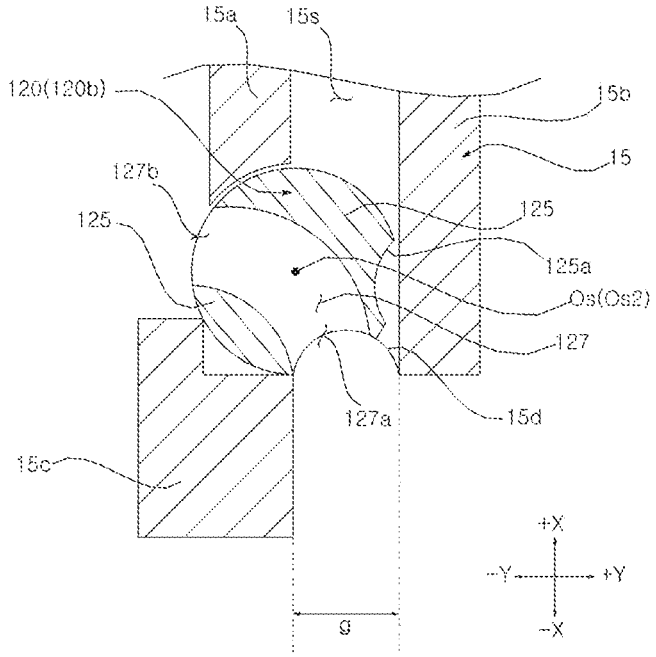

Referring to FIGS. 7, 9 and 11*c*, the clothing treatment apparatus 1 may include the through-channel 127. The through-channel 127 may be an inlet/outlet of air between the outside and the inside of the cabinet 10. Here, the inside of the cabinet 10 is meant to include the treatment space 10*s* and the machine room 18. The through-channel 127 includes at least one of an outside air inlet channel 127 and an exhaust outlet channel 127.

Referring to FIGS. 7(*a*) and 9, the through-channel 127 may include the outside air inlet channel 127 between the outer space Ou and the outside air channel Pc. The outside air inlet channel 127 may refer to the through-channel 127 of the outside air opening/closing module 100*a*. The outside air of the outer space Ou may be sucked through the outside air inlet channel 127. The outside air inlet channel 127 may guide the outside air so that the outside air flows into the outside air channel Pc. The outside air inlet channel 127 may be formed in a hole shape. The outside air inlet channel 127 may be disposed in the door 15.

Referring to FIGS. 7(*b*) and 9, the through-channel 127 may include the exhaust outlet channel 127 between the treatment space 10*s* and the outer space Ou. The exhaust inlet channel 127 may be referred to the through-channel 127 of the exhaust opening/closing module 100*b*. Exhaust air can be discharged to the outer space Ou through the exhaust outlet channel 127. The exhaust outlet channel 127 may guide the exhaust air so that the exhaust air is discharged from the treatment space 10*s* to the outer space Ou. The exhaust outlet channel 127 may be formed in a hole shape. The exhaust outlet channel 127 may be disposed in the door 15.

Referring to FIG. 11*a*, the first inside air channel Pa may be formed by sequentially connecting the inside air inflow section P1 and the shared section P0. In a state where a first valve 70*a* is open and a second valve 70*b* is closed, a first inlet (not illustrated) connecting the inside air inlet air inflow section P1 and the shared section P0 to each other is opened, and a second inlet (not illustrated) connecting the inside air inflow section P1 and the filter passage section P2 to each other is closed. In this case, the opening/closing modules 100 and 100' block the through-channel 127. The outside air opening/closing module 100*a* blocks the outside air inlet channel 127, and the exhaust opening/closing module 100*b* blocks the exhaust outlet channel 127. Air flows from the treatment space 10*s* into the inside air inflow section P1 through an inner intake port 41. The air from the inside air inflow section P1 to the shared section P0 through the first inlet. The air passing through the shared section P0 is discharged to the treatment space 10*s* through the inner discharge port 44.

Referring to FIG. 11B, the second inside air channel Pb may be formed by sequentially connecting the bet inlet section P1, the filter passage section P2, and the shared section P0. In a state where the first valve 70*a* closed and the second valve 70*b* open, the first inlet is closed and the second inlet is opened. In this case, the opening/closing modules 100 and 100' block the through-channel 127. In this case, the outside air opening/closing channel 100*a* blocks the outside air inlet channel 127, and the exhaust opening/closing module 100*b* blocks the exhaust outlet channel 127. Air flows from the treatment space 10*s* to the inside air inflow section P1 through the inner intake port 41. The air flows from the inside air inflow section P1 to the filter passage section P2 through the second inlet. The air passing through the filter unit 95 in the filter passage section P2 flows into the shared section P0. The air passing through the shared section P0 is discharged to the treatment space 10*s* through the inner discharge port 44.

Referring to FIG. 11*c*, the outside air channel Pc may be formed by sequentially connecting the filter passage section P2 and the shared section P0 to each other. In a state where both the first valve 70*a* and the second valve 70*b* are closed, both the first inlet and the second inlet are closed. In this case, the opening/closing modules 100 and 100' open the through-channel 127. In this case, the outside air opening/closing channel 100*a* opens the outside air inlet channel 127, and the exhaust opening/closing module 100*b* opens the exhaust outlet channel 127. Outside air flows from the outer space Ou into the outside air inlet channel 127. The air flows from the outside air inlet channel 127 into the filter passage section P2 through the outside air connector 45. The air passing through the filter unit 95 in the filter passage section P2 flows into the shared section P0. The air passing through the shared section P0 is discharged to the treatment space 10*s* through the inner discharge port 44. The air in the treatment space 10*s* is discharged to the outer space Ou through the exhaust outlet channel 127.

Referring to FIGS. 11*a* and 11*b*, the inside air channels Pa and Pb may be selected when the valve module 70 opens the inside air channels Pa and Pb and the opening/closing modules 100 and 100' blocks the through-channel 127. In this case, the valve module 70 may open at least one of the plurality of inside air channels Pa and Pb.

Referring to FIG. 11*c*, the outside air channel Pc may be selected when the valve module 70 blocks the inside air channels Pa and Pb and the opening/closing modules 100 and 100' opens the through-channel 127. In this case, the opening/closing modules 100 and 100' may open at least one of the plurality of through-channels 127.

Referring FIGS. 6 to 9, through-channel 127 may be changed whether or not to be blocked by the opening/closing modules 100 and 100'. The outside air inlet channel 127 may be provided to be opened and closed by the outside air opening/closing module 100*a*. The exhaust outlet channel 127 may be provided to be opened and closed by the exhaust opening/closing module 100*b*.

In a state where the inside air channels Pa and Pb are selected (refer to FIGS. 11*a* and 11*b*), the through-channel 127 is closed (refer to FIGS. 7 and 9). In the state where the through-channel 127 is closed, the air sucked into the inside air channels Pa and Pb from the treatment space 10*s* through the inner intake port 41 may be subjected to a predetermined treatment, and may be discharged to the treatment space 10*s* through the inner discharge port 44.

In a state where the outside air channel Pc is selected (refer to FIG. 11*c*), the through-channel 127 is opened (refer to FIGS. 7 and 9). In the state where the through-channel 127 is open, air sucked from the outer space Ou into the outside air channel Pc through the outside air inlet channel 127 may be subjected to a predetermined treatment and may be discharged to the treatment space 10*s* through the inner discharge port 44. In the state where the through-channel 127 is open, the air in the treatment space 10*s* may be discharged through the exhaust outlet channel 127 to the outer space Ou.

Referring to FIG. 9, the louver member 120 to be described later may form the through-channel 127. In the present embodiment, the louver member 120 forming the inlet channel 127 and the louver member 120 forming the exhaust outlet channel 127 may have the same structure as each other. Both ends of the through-channel 127 may form the outer opening portions 127*a* and the inner opening portions 127*b*, respectively. In the state where through-channel 127 is open, the outer opening portion 127*a* is formed to face the outer space Ou. In the state where the through-channel 127 is closed, the inner opening portion 127*b* is formed to face the main bodies 11, 12, 13, and 14. In the state where the through-channel 127 is closed, at least one of the outer opening portion 127*a* and the inner opening portion 127*b* is blocked. In the present embodiment, at least one of the outer opening portion 127*a* and the inner opening portion 127*b* is blocked by the door 15, and thus, the through-channel 127 is closed.

Referring to FIGS. 7(*a*) and 9, the air flow direction Af on the outside air inlet channel 127 is from the outer opening portion 127*a* to the inner opening portion 127*b*. Referring to FIGS. 7(*b*) and 9, the air flow direction Af on the exhaust outlet channel 127 is from the inner opening portion 127*b* to the outer opening portion 127*a*.

A recessed groove may be formed in the side surface portion of the cabinet 10. In the state where the through-channel 127 is open, preferably, the outer opening portion 127*a* is disposed on the side surface portion of the cabinet 10. Accordingly, when a user looks at the clothing treatment apparatus 1 from the front, the outer opening portion 127*a* is visually obscured to form a neat appearance. In addition, the side surface portion of the cabinet 10 may be obscured by other objects (such as other furniture or walls). In this case, the outer opening portion 127*a* is disposed in the groove of the side surface portion of the cabinet 10, and thus, even when the side surface portion of the cabinet 10 is obscured by the other objects, the flow of the outside air sucked through the space formed by the groove or the exhaust air discharged may be smooth. The side surface portion of the cabinet 10 mentioned here may be side surface portions of the main bodies 11, 12, 13, and 14, or may be a side surface portion of the door as in the present embodiment. (refer to FIGS. 9 and 10)

Referring to FIGS. 7 and 9, the outer opening portion 127*a* is disposed in one region of the side surface portion of the door 15 when the through-channel 127 is open and faces the outer space Ou in a lateral direction (X-axis direction). For example, one area of the side surface portion of the door 15 may be a portion of the side surface portion of the door 15 which is not covered by the door side surface portion 15*d*. In the state where the outside air inlet channel 127 is open, the outer opening portion 127*a* of the outside air inlet channel 127 is disposed on the side surface portion of the door 15. In the state where the exhaust outlet channel 127 is open, the outer opening portion 127*a* of the exhaust outlet channel 127 is disposed on the side surface portion of the door 15. If the outer opening portion is disposed in a front direction, air may be blown in the front direction to cause discomfort to the user and apparently to cause discomfort. In addition, if the outer opening portion is formed in an upper direction, dust accumulated on an upper surface of the clothing treatment apparatus 1 may be blown or sucked into the cabinet 10, which may be a problem. In addition, if the outer opening portion is formed in the rear or side direction of each of the main bodies 11, 12, 13, and 14, outside air intake and/or exhaust discharge is interfered by other objects (such as other furniture or walls) disposed on the side and rear. This will interfere. The side surface portion of the door 15 is a portion which is exposed when the user opens the door. Meanwhile, the outer opening portion 127*a* is disposed on the side surface portion of the door in a lateral direction. Accordingly, a possibility that the suction of the outside air and/or the discharge of the exhaust air is interrupted by other objects is minimized, the user can directly solve a problem caused by the air blowing, and it is possible to prevent the dust accumulated on the upper surface from being sucked/blown.

Figure 6:
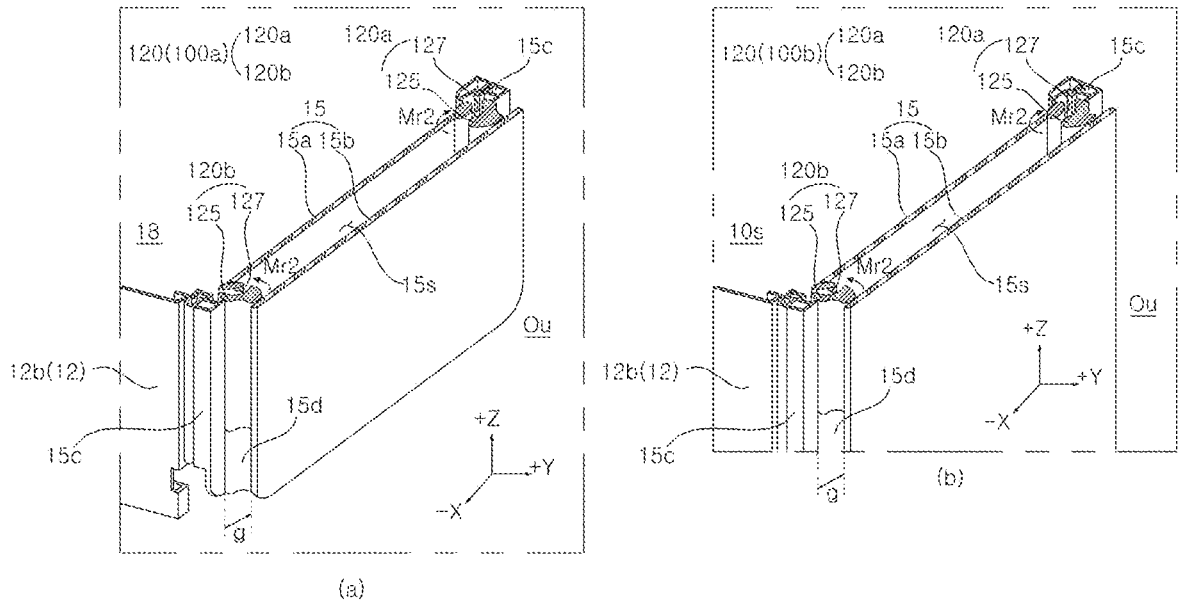
FIG. 6 is a view illustrating a state where a through-channel 127 is blocked, FIG. 6(*a*) is a cross-sectional perspective view when the clothing treatment apparatus 1 of FIG. 1 is horizontally taken along line S1-S1', and FIG. 6(*b*) is a cross-sectional perspective view when the clothing treatment apparatus 1 of FIG. 1 is horizontally taken along line S2-S2'.
Figure 8:
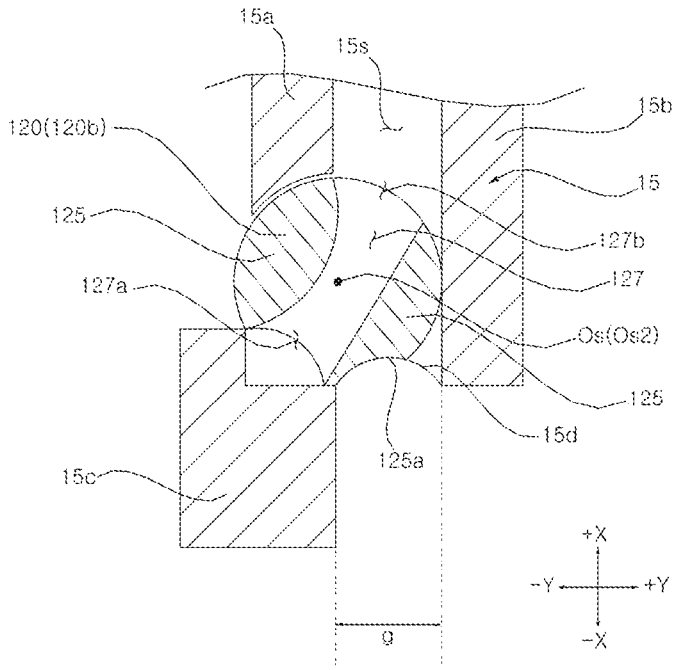
FIGS. 8 and 9 are conceptual views when a cross section of a portion where a louver member 120*b* of FIGS. 6 and 7 is located is viewed from above.

Referring to FIGS. 6 and 8, the opening/closing modules 100 and 100' may include an exposure blocking portion 125*a* disposed in place of the outer opening portion 127*a* in the one region in the state where the through-channel 127 is closed. In the present embodiment, the louver member 120 rotates about a predetermined louver rotation axis Os, and thus, the through-channel 127 is changed from an open state to a closed state, and the exposure blocking portion 125*a* is changed to be exposed in the lateral direction. The exposure blocking portion 125*a* may be recessed to form a groove extending parallel to the hinge axis Oh. Accordingly, in the state where the through-channel 127 is closed, the user can easily open and close the door 15 by holding a hand in the groove of the exposure blocking portion 125*a*. That is, the exposure blocking portion 125*a* can implement an efficient structure capable of blocking the through-channel 127 and simultaneously performing the handle function of the door 15.

Figure 10:
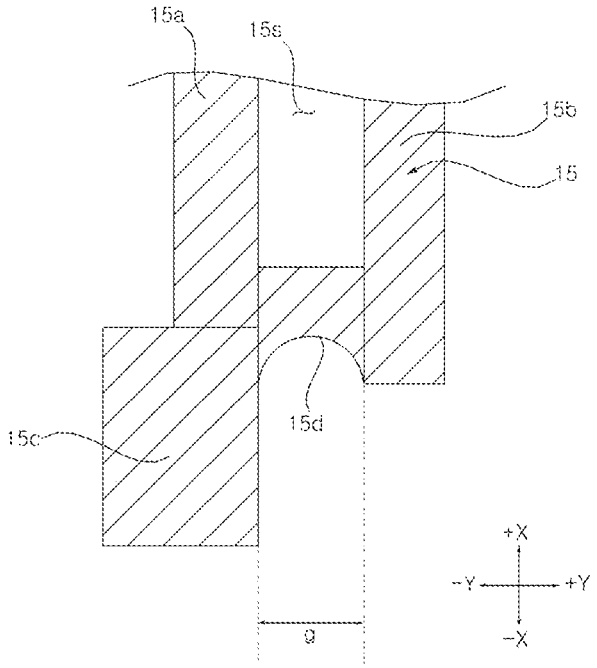
FIG. 10 is a cross-sectional conceptual view illustrating a portion of the door 15 of FIG. 1 horizontally taken along line 3-3'.

Referring to FIGS. 6, 8 and 10, in the state where the through-channel 127 is closed, the groove of the exposure blocking portion 125*a* may be disposed on an extension line of the groove of the door 15. The groove formed in the door side surface portion 15*d* and the groove of the exposure blocking portion 125*a* may be connected to each other in an up-down direction. Accordingly, the user can hold the groove of the door side surface portion 15*d* by the hand of the user or the groove of the exposure blocking portion 125*a* by the hand of the user to open or close the door 15, and can hold a boundary point between the groove of the side surface portion 15*d* of the door and the groove of the exposure blocking portion 125*a* by the hand of the user to open or close the door 15 without inconvenience.

Referring to FIGS. 1 to 3 again, the inner intake port 41 for sucking air in the treatment space 10*s* is provided. The inner intake port 41 is disposed in the inner cabinet 10*a*. The inner intake port 41 may be disposed on a bottom surface of the inner cabinet 10*a*. The inner intake port 41 may be formed between the cover 25 and the inner cabinet 10*a*. The air in the treatment space 10*s* can flow into the inside air channels Pa and Pb through the inner intake port 41.

The inner discharge port 44 for discharging air into the treatment space 10*s* is provided. The inner discharge port 44 is disposed in the inner cabinet 10*a*. The inner discharge port 44 may be disposed on the bottom surface of the inner cabinet 10*a*. A radial network structure may be formed in the inner discharge port 44. The air in the inside air channels Pa and Pb may be discharged into the treatment space 10*s* through the inner discharge port 44. The air in the outside air channel Pc can be discharged into the treatment space 10*s* through the inner discharge port 44.

In the state where the inside air channels Pa and Pb are selected, the air sucked into the duct 40 from the treatment space 10*s* through the inner intake port 41 is subjected to a predetermined treatment and is discharged to the treatment space 10*s* through the inner discharge port 44. In the present embodiment, the inner intake port 41 and the inner discharge port 44 are disposed at the front and rear of the bottom of the treatment space 10*s*, respectively.

Referring to FIGS. 1 to 3 and 11*c*, in the state where the door 15 is closed, air passing through the outside air inlet channel 127 flows into the outside air channel Pc through the outside air connector 45. The air sequentially passing through the outside air inlet channel 127 and the outside air connector 45 flows into the duct 40. The outside air connector 45 may be open toward the rear surface of the door 15. The outside air connector 45 may be formed at a position corresponding to the inner opening portion 127*b* of the outside air inlet channel 127 in the state where the door 15 is closed.

A plurality of outside air connectors 45*a* and 45*b* may be provided corresponding to the plurality of outside air inlet channels 127 disposed in the door 15. The plurality of louver members 120*a* and 120*b* may form the outside air inlet channels 127, respectively. In the present embodiment, a pair of outside air inlet channels 127 formed by a pair of louver members 120*a* and 120*b* is provided. The first outside air connector 45*a* and the second outside air connector 45*b* may be provided corresponding to each inner opening portion 127*b* of the pair of outside air inlet channels 127. The first outside air connector 45*a* and the second outside air connector 45*b* may be disposed symmetrically from side to side. The first outside air connector 45*a* and the second outside air connector 45*b* may be disposed with a condensate storage unit 28 and a supply water storage unit 29 interposed therebetween.

Refer to FIGS. 2 and 3, the cover 25 may form the inner intake port 41 and cover a side surface of the filter module 90 in a withdrawal direction. The cover 25 may form the inner intake port 41 through which air flows into the inside air channels Pa and Pb. The inner intake port 41 may be formed by a gap between the cover 25 and the bottom surface of the treatment space 10*s*. The cover 25 may cover the side surface of the filter module 90 in the withdrawal direction. The cover 25 may be detachably disposed on the cabinet 10. The cover 25 may be detachably disposed on the inner cabinet 10*a*. The cover 25 may be disposed detachably from the bottom surface of the treatment space 10*s*.

Referring to FIGS. 11*a* to 11*c*, the fan 50 applies a pressure to air moving the duct 40. The fan 50 is disposed in the duct 40. The fan 50 may be disposed in the shared section P0. Accordingly, even if any one of the plurality of channels is selected, it is possible to guide the air so that the air flows in the duct 40 by one fan 50.

The fan 50 may be disposed at a rear portion of the duct 40. The fan 50 may be disposed closer to the inner discharge port 44 than the inner intake port 41. The shared section P0 forms a channel which guides the flow of air from the front to the rear, and then bends upward and forms a channel which guides the air to the inner discharge port 44. The fan 50 may be disposed at a point bent upward of the shared section. The fan 50 may be implemented as a centrifugal fan.

Referring to 11*a* to 11*c*, the heat exchange module 60 is disposed on the inside air channels Pa and Pb. The heat exchange module 60 is disposed in the duct 40. The heat exchange module 60 may be disposed in a shared section P0 to be described later. Accordingly, even if any of the plurality of channels is selected, the air in the duct 40 can be treated by one heat exchange module 60.

The heat exchange module 60 may heat air moving in the duct 40. Specifically, the heat exchange module may include a first heat exchanger 61 serving as an evaporator and a second heat exchanger 63 serving as a condenser. The heat exchange module 60 may include a compressor (not illustrated) and an expansion valve (not illustrated). The heat exchange module 60 may include a refrigerant cycle sequentially passing through the compressor, the condenser, the expansion valve, and the evaporator. First, the air in the duct 40 passes through the first heat exchanger 61, and moisture in the air condenses, and the air having a small heat capacity due to condensation water is heated through the second heat exchanger 63. Accordingly, the air after passing through the second heat exchanger 63 has lower humidity and higher temperature than the air before going through the first heat exchanger 61.

Although not illustrated, in another embodiment, the heat exchange module 60 may include a cooling apparatus that allows the treated air to be cooled rather than the air before treatment.

Whether or not the heat exchange module 60 is operated can be controlled by the controller 2. The fan 50 may be operated in a state in which the heat exchange module 60 is not operated, and thus, the air which flows through the duct 40 and is not separately heated may be supplied into the treatment space 10*s*.

Referring to FIGS. 2 and 3, the clothing treatment apparatus 1 may include a condensate storage unit 28 which stores condensate generated in the heat exchange module 60. The condensate generated in the first heat exchanger 61 of the heat exchange module 60 may be collected into the condensate storage unit 28. The condensate storage unit 28 may be disposed to be withdrawable. In the state where the door 15 is open, the condensate storage unit 28 can be withdrawn from the front.

The clothing treatment apparatus 1 may include a steam module 7 which supplies steam into the treatment space 10*s*. The steam module 7 may include a steam generator (not illustrated) for generating steam, and a steam injection port 21 for discharging the generated steam into the treatment space 10*s*. The steam generator may be disposed in the machine room 18. The steam injection port 21 is disposed in the inner cabinet 10*a*. In the present embodiment, the steam injection port 21 is disposed in a rear portion of the bottom surface of the treatment space 10*s*.

The clothing treatment apparatus 1 may include the supply water storage unit 29 which stores water for supply to the steam module 7. The water in the supply water storage unit 29 can be moved to the steam generator and can be changed to steam. The supply water storage unit 29 may be disposed to be withdrawable. In the state where the door 15 is open, the supply water storage unit 29 can be withdrawn from the front.

Figure 4:
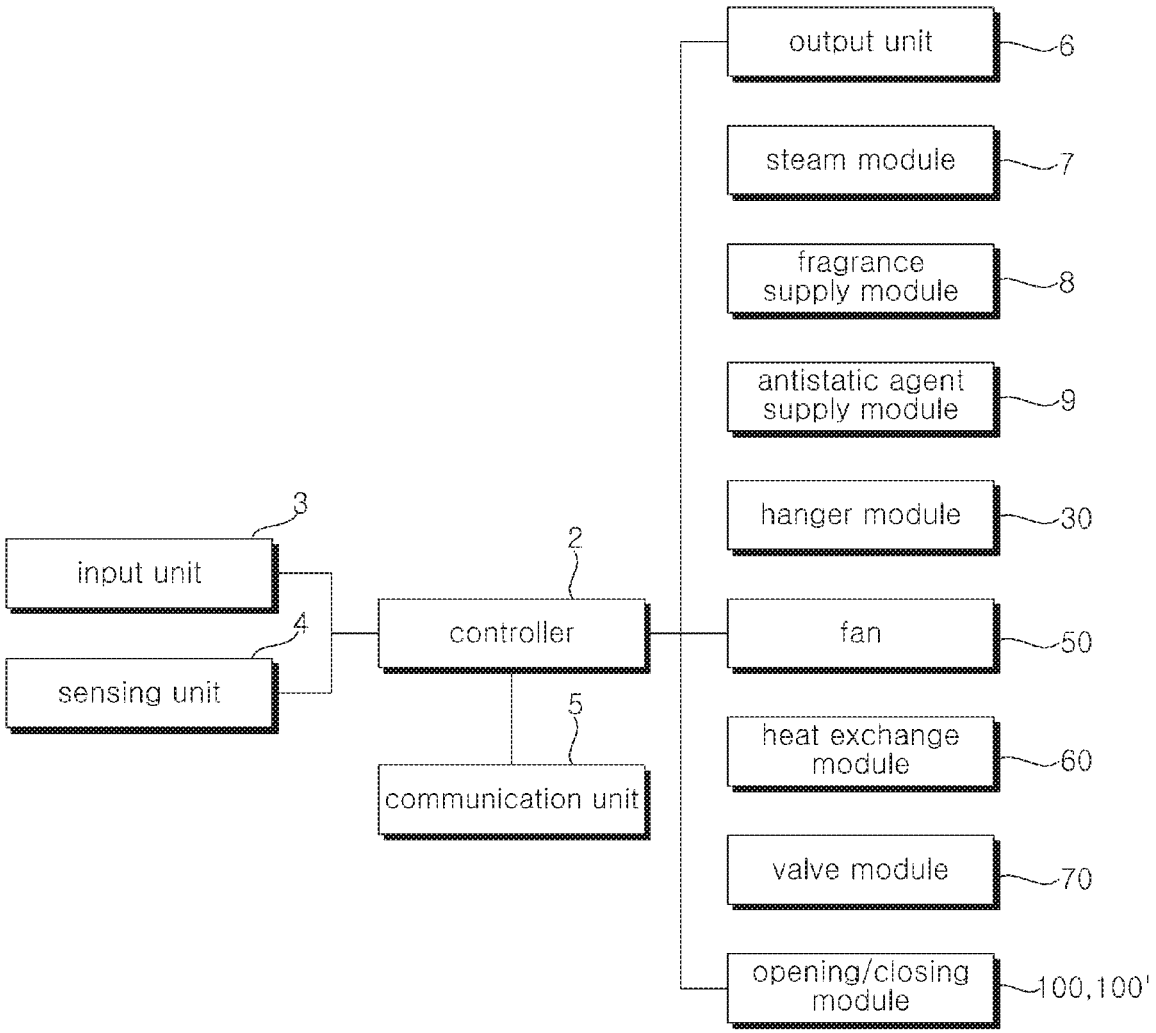
FIG. 4 is a control block diagram of the clothing treatment apparatus 1 of FIG. 1.

Referring to FIG. 4, the clothing treatment apparatus 1 may include an input unit 3 which receives On/Off or various commands. The input unit 3 may include keys, buttons, dials and/or touch screens.

The clothing treatment apparatus 1 may include a sensing unit 4 which detects environmental information for clothing treatment. The environmental information may include information of clothing accommodated in the treatment space 10*s*. The environmental information may include information on a condition of the air inside the treatment space 10*s*. The environmental information may include air condition information in the duct 40. The environment information may include air condition information of the outer space Ou.

The air condition information may include temperature information. The air condition information may include humidity information. The air condition information may include air pollution information.

For example, the sensing unit 4 may include a clothing recognition sensor (not illustrated) for sensing clothing accommodated inside the treatment space 10*s*. The sensing unit 4 may include a humidity sensor (not illustrated) which senses the humidity of the air. The sensing unit 4 may include a temperature sensor (not illustrated) which senses the temperature of the air. The humidity sensor and the temperature sensor may be implemented as a temperature/humidity sensor which simultaneously detects the humidity and temperature.

The clothing treatment apparatus 1 may include a communication unit 5 provided to communicate with an external server, a terminal and/or a charging stand.

The clothing treatment apparatus 1 may include an output unit 6 for notifying the user of various information. The output unit 6 may include a speaker and/or a display.

The clothing treatment apparatus 1 may further include a fragrance supply module 8 which supplies a fragrance into the treatment space 10*s*. The clothing treatment apparatus 1 may further include an antistatic agent supply module 9 for supplying an antistatic agent into the treatment space 10*s*.

The controller 2 may receive and process information from the input unit 3. The controller 2 may receive information or transmit information through the communication unit 5. The controller 2 can control various components 6, 7, 8, 9, 50, 60, 80, 47, and 48 based on the information received through the input unit 3 or the communication unit 5.

The controller 2 may receive and process the environmental information sensed by the sensing unit 4. The controller 2 can control various components 6, 7, 8, 9, 30, 50, 60, 80, 47, and 48 based on the environmental information sensed by the sensing unit 4. For example, the controller 2 may control the clothing treatment apparatus 1 so that the clothing treatment apparatus 1 selects a ventilation mode to be described later on the basis of environmental information that the humidity of the air in the outer space Ou is lower than the humidity of the air in the treatment space 10*s*.

The controller 2 may control an output of the output unit 6. The controller 2 may control an operation of the steam module 7. The controller 2 may control an operation of the fragrance supply module 8. The controller 2 may control an operation of the antistatic agent supply module 9. The controller 2 may control an operation of the fan 50. The controller 2 may control an operation of the heat exchange module 60. The controller 2 may control the vibrations of the hanger module 30.

The controller 2 may control the operations of the opening/closing module 100 and 100'. The controller 2 may control the opening/closing modules 100 and 100' so that any one of the plurality of channels is selected. The controller 2 may operate the opening/closing modules 100 and 100' so that one of the outside air channels Pc and inside air channels Pa and Pb can be changed to the other.

The controller 2 may control the operation of the valve module 70. The controller 2 may control the valve module 70 so that any one of the plurality of channels is selected.

When the opening/closing modules 100 and 100' and the valve module 70 are operated, a "selected channel" among the plurality of channels is changed. Here, the selected channel means any one selected among the plurality of channels in a current mode by the controller 2. For example, the selected channel is the first inside air channel Pa in FIG. 11*a*, the selected channel is the second inside air channel Pb in FIG. 11*b*, and the selected channel is the outside air channel Pc in FIG. 11*c*.

Referring to 11*a* to 11*c*, according to the operation of the valve module 70, one selected channel of the plurality of channels Pa, Pb, and Pc may be changed to another selected channel. The operation of the valve module 70 may mean opening and closing of the valve module 70.

The valve module 70 includes at least one valve. The at least one valve may include the first valve 70*a* and the second valve 70*b*.

The first inlet may be disposed on a downstream side of the inner intake port 41. The first inlet may be disposed on the downstream end of the inside air inflow section P1. The first inlet may be disposed on the upstream end of the shared section P0. The second inlet may be disposed on the downstream side of the inner intake port 41. The second inlet may be disposed on the downstream end of the inside air inflow section P1. The second inlet may be disposed on the upstream end of the filter passage section P2.

The first inlet and the second inlet may be disposed on the same plane. The first inlet and the second inlet may be disposed to be spaced apart from each other. The first inlet and the second inlet may be disposed with the filter module 90 therebetween. A filter module insertion hole (not illustrated) into which the filter module 90 is inserted to be withdrawable may be formed between the first inlet and the second inlet.

The valve module 70 may include the first valve 70*a* which is disposed on the first inside air channel Pa and opens or closes the channel. The first valve 70*a* may open and close the first inlet. The first valve 70*a* opens the first inlet when the first inside air channel Pa is selected. The first valve 70*a* closes the first inlet when the second inside air channel Pb is selected. The first valve 70*a* closes the first inlet when the outside air channel Pc is selected.

The valve module 70 may include the second valve 70*b* which is disposed on the second inside air channel Pb and opens or closes the channel. The second valve 70*b* may open or close the second inlet. The second valve 70*b* opens the second inlet when the second inside air channel Pb is selected. The second valve 70*b* closes the second inlet when the first inside air channel Pa is selected. The second valve 70*b* closes the second inlet when the outside air channel Pc is selected.

The valve module 70 is provided at a position at which the valve module 70 does not block the outside air channel Pc when blocking the inside air channels Pa and Pb. Referring to 11*a* to 11*c*, regardless of the opening and closing of the channel of the valve module 70, whether or not the outside air channel Pc is blocked is changed according to the opening or closing of he through-channel 127 of the opening/closing modules 100 and 100'. The valve module 70 may be disposed on the downstream end of the inside air inflow section P1.

The first valve 70*a* may include a shaft portion (not illustrated) which is rotatably supported by the duct 40 and an opening/closing portion (not illustrated) which is rotated to open and close the first inlet. The second valve 70*b* may include a shaft portion (not illustrated) which is rotatably supported by the duct 40 and an opening/closing portion (not illustrated) that is rotated to open and close the second inlet.

The clothing treatment apparatus 1 includes a valve operating unit (not illustrated) which provides a drive force of the at least one valve. The valve operating unit includes a motor (not illustrated). The valve operating unit may provide drive forces of the first valve 70*a* and the second valve 70*b*.

Referring to FIGS. 11*a* to 11*c*, the filter module 90 is disposed on the air channel formed by the duct 40. The filter module 90 may be disposed between the first valve 70*a* and the second valve 70*b*.

The filter module 90 is provided to be drawn in and out through the filter module insertion hole formed in the duct 40. In a state where the filter module 90 is fully inserted into the filter module insertion hole, the filter unit 95 is disposed in the filter passage section P2 in the duct 40. The filter module 90 may be provided to be withdrawable in a direction crossing the second inside air channel Pb and the outside air channel Pc. In the present embodiment, the filter module 90 is provided to be withdrawable upward. The filter module 90 may be provided to be withdrawable from the bottom surface of the treatment space 10*s*.

The filter module 90 includes a filter unit 95 which filters foreign substances passing therethrough. The filter unit 95 has a different function from the auxiliary filter. The filter unit 95 can filter even foreign matter relatively smaller than the auxiliary filter.

The filter unit 95 may include a High Efficiency Particulate Air filter (HEPA). The HEPA filter is consumable and needs replacement. The HEPA filter filters relatively small fine dust, bacteria, and fungi. For example, the HEPA filter maintains a filtration rate of 99.97% or more with particles of about 0.3μ. For example, the HEPA filter may be formed of a material of glass fibers or asbestos fibers.

The HEPA filter cannot be washed with water, and can be cleaned by brushing with a brush or brush. Accordingly, it is necessary that the HEPA is provided so that no vapor passes above a predetermined value. By providing the second inside air channel Pb or the outside air channel Pc, it is possible to include the first inside air channel Pa while using the high-performance function of the HEPA filter. Accordingly, when the steam is supplied into the treatment space through the steam module 7, it is possible to guide the steam so that the steam does not pass through the HEPA.

The filter module 90 includes a filter body portion 91 which supports the filter unit 95. The filter unit 95 may be detachably disposed on the filter body portion 91. In order to replace the filter unit 95, after the filter body portion 91 is withdrawn from the duct 40, the filter unit 95 can be removed from the filter body portion 91.

The filter module 90 may include a filter handle (not illustrated) provided for a user to hold the filter module 90 by the hand of the user while the filter body portion 91 is completely drawn into the duct 40. The filter handle is fixed to the filter body portion 91. The filter handle may be disposed on an upper side of the filter body portion 91. When the cover 25 and the auxiliary filter are removed, the filter handle may be provided to be exposed.

Although not illustrated, the auxiliary filter may be disposed between the filter module 90 and the cover 25. The auxiliary filter may be disposed on upstream sides of the first inlet and the second inlet. The auxiliary filter may be disposed on the upstream side of the filter module 90. The auxiliary filter may be disposed on the downstream side of the cover 25. The cover 25 may cover a side surface of the auxiliary filter in a removal direction.

The auxiliary filter may be supported by a duct 40. The auxiliary filter may be disposed detachably. The auxiliary filter may be detachably disposed in the inner cabinet 10*a*. The auxiliary filter may be disposed detachably from the bottom surface of the treatment space 10*s*.

The auxiliary filter filters foreign substances in the air moving to the inside air channels Pa and Pb through the inner intake port 41. The auxiliary filter may filter dust from the air passing through the auxiliary filter, but may have a different function from the filter unit 95. The auxiliary filter is not the HEPA filter. For example, the auxiliary filter may include a mesh filter. For example, the auxiliary filter may filter only foreign substances which are relatively bulky compared to the filter unit 95. The auxiliary filter is provided so that steam can pass through the auxiliary filter. Accordingly, it is possible to add an auxiliary filtering function to both the first inside air channel Pa and the second inside air channel Pb by one auxiliary filter.

The user can open the door 15, remove the cover 25, and then take out the filter module 90. After the user removes the cover 25, the user may remove the filter module 90 after removing the auxiliary filter to be described later.

Hereinafter, referring to FIGS. 5 to 9 and FIGS. 12 to 16*b*, the opening/closing modules 100 and 100' will be described in detail as follows. In order to separately describe the first and second embodiments, quotation marks (') are inserted after reference signs of the configurations of the second embodiment different from those of the first embodiment.

The opening/closing modules 100 and 100' are operated to change whether or not the through-channel 127 is blocked. The opening/closing modules 100 and 100' may form at least a portion of the through-channel 127. The louver member 120 of the opening/closing modules 100 and 100' forms at least portion of the through-channel 127. At least a portion of the through-channel 127 formed in the louver member 120 rotates integrally with the louver member 120, and thus, whether or not to block the through-channel 127 is changed.

The opening/closing modules 100 and 100' are disposed in the cabinet 10. The opening/closing modules 100 and 100' may be disposed in the door 15. In this case, the through-channel 127 is disposed in the door 15. The outside air may enter the outside air channel Pc through the door 15. The exhaust air may flow to the outer space Ou through the door 15.

The plurality of opening/closing modules 100*a* and 100*b* may be provided. The opening/closing module 100 and 100' include the outside air opening/closing module 100*a* which is operated to change whether or not the outside air inlet channel 127 is blocked. The opening/closing modules 100 and 100' include the exhaust opening/closing module 100*b* which is operated to change whether or not the exhaust outlet channel 127 is blocked.

The louver member 120 of the outside air opening/closing module 100*a* forms at least portion of the outside air inlet channel 127. The louver member 120 of the exhaust opening/closing module 100*b* forms at least portion of the exhaust outlet channel 127. The outside air opening/closing module 100*a* may be disposed in the door 15. The exhaust opening/closing module 100*b* may be disposed in the door 15.

The outside air opening/closing module 100*a* and the exhaust opening/closing module 100*b* may be disposed on the door to be spaced away from each other vertically. The outside air opening/closing module 100*a* may be disposed above the exhaust opening/closing module 100*b*. In the state where the door 15 is closed, the outside air opening/closing module 100*a* can be disposed on the front side of the machine room 18. In the state where the door 15 is closed, the exhaust opening/closing module 100*b* may be disposed on the front side of the treatment space 10*s*. The controller 2 controls the outside air opening/closing module 100*a* and the exhaust opening/closing module 100*b* so that both the outside air inlet channel 127 and the exhaust outlet channel 127 are open or closed.

The opening/closing modules 100 and 100' include the louver member 120 which is operated to change whether or not the through-channel 127 is blocked. The opening/closing modules 100 and 100' include the moving members 150 and 150' which operate the louver member 120 as the opening/closing modules 100 and 100' moves in a predetermined moving direction Mp1. The opening/closing modules 100 and 100' include the drive assemblies 160 and 160' having motors 168 and 168' which generate a drive force. The drive assemblies 160 and 160' converts the drive force of the motors 168 and 168' to move the moving members 150 and 150' in the moving direction Mp1.

Referring to FIGS. 6 to 9 and 12, a plurality of the louver members 120 may be provided. The plurality of louver members 120*a* and 120*b* operated by one drive assembly 160 or 160' may be provided. A pair of louver members 120*a* and 120*b* operated by one drive assembly 160 or 160' may be provided. The pair of louver members 120*a* and 120*b* may be spaced apart from each other. The pair of louver members 120*a* and 120*b* may be spaced apart in both directions of the door 15. The pair of louver members 120*a* and 120*b* may include the first louver member 120*a* and the second louver member 120*b*. The first louver member 120*a* and the second louver member 120*b* may be provided to be operated simultaneously by one drive assembly 160 or 160'.

A plurality of the through-channels 127 spaced apart from each other may be provided. The plurality of through-channels 127 whose blocking is changed by one drive assembly 160 or 160' may be provided. A plurality of outside air inlet channels 127 whose blocking is changed by one drive assembly 160 or 160' may be provided. A plurality of exhaust outlet channels 127 whose blocking is changed by one drive assembly 160 or 160' may be provided. The pair of through-channels 127 whose blocking is changed by one drive assembly 160 or 160' may be spaced apart from each other. The pair of through-channels 127 may be spaced apart in both directions of the door 15. The pair of louver members 120*a* and 120*b* corresponds to the pair of through-channels 127. At least a portion of the pair of through-channels 127 may be formed on the first louver member 120*a* and the second louver member 120*b*, respectively. The first louver member 120*a* and the second louver member 120*b* are operated such that the pair of through-channels 127 are opened or closed simultaneously.

The louver member 120 may be rotatably disposed with respect to the cabinet 10. The louver member 120 may rotate in a predetermined rotational direction to open and close the through-channel 127. The louver member 120 may be provided to rotate around the predetermined louver rotation axis Os. The first louver member 120*a* may be provided to be rotated about the predetermined first louver rotation axis Os1. The second louver member 120*b* may be provided to be rotated about the predetermined second louver rotation axis Os2.

The louver rotation axes Os, Os1, and Os2 can be extended in the up-down direction. The louver rotation axes Os, Os1, and Os2 may be disposed to be parallel to the hinge axis Oh. The first louver rotation axis Os1 and the second louver rotation axis Os2 may be disposed to be parallel to each other.

The louver member 120 is provided to be rotatable in the clockwise direction and the counterclockwise direction about the louver rotation axes Os, Os1, and Os2. In the clockwise and counterclockwise directions about the louver rotation axes Os, Os1, and Os2 of the louver member 120, a rotation direction of the corresponding through-channel 127 is changed from the closed state to the open state is defined as a louver rotation direction Mp2, and a rotation direction of the corresponding through-channel 127 is changed from the open state to the closed state is defined as a reverse rotation direction Mr2 of the louver rotation direction.

At least a portion of the through-channel 127 is formed to penetrate the louver member 120. For example, the entire section of the through-channel 127 is formed in the louver member 120, and the entire section of the through-channel 127 may be integrally rotated according to the rotation of the louver member 120. As another example, a partial section of the through-channel 127 are formed in the louver member 120, and according to the rotation of the louver member 120, only a partial section of the through-channel 127 is integrally rotated and the remaining section of the through-channel 127 may maintain a constant position. In both the above-described example and other examples, in the state where the through-channel 127 is open, the entire section of the through-channel 127 forms a channel through the door 15, and in the state where the through-channel 127 is closed, the through-channel 127 is blocked.

The louver member 120 includes a blocking portion 125 which forms at least a portion of the through-channel 127. The blocking portion 125 forms at least a portion of the through-channel 127 which moves integrally with the louver member 120. The blocking portion 125 may form a gap corresponding to the through-channel 127. The blocking portion 125 extends to be parallel to the louver rotation axis Os.

One end of the through-channel 127 formed by the blocking portion 125 is the outer opening portion 127*a* and the other end is the inner opening portion 127*b*. As the blocking portion 125 rotates, the through-channel 127 formed by the blocking portion 125 rotates integrally, and when at least one of the outer opening portion 127*a* and the inner opening portion 127*b* is blocked by the door 15, the through-channel 127 is closed. In addition, when the outer opening portion 127*a* and inner opening portion 127*b* respectively face the outer space Ou and the inner portion (treatment space or outside air channel) of the cabinet, the through-channel 127 is open. In the state where the through-channel 127 is open, the outer opening portion 127*a* is located in the gap g of the door 15 to face the outer space Ou. In the state where the through-channel 127 of the outside air opening/closing module 100*a* is open, the inner opening portion 127*b* faces the outside air connector 45. In the state where the through-channel 127 of the exhaust opening/closing module 100*b* is open, the inner opening portion 127*b* faces the treatment space 10*s*.

The blocking portion 125 includes the exposure blocking portion 125*a*. In the state where the through-channel 127 is open, the exposure blocking portion 125*a* may be covered by the door 15. In the state where the through-channel 127 is closed, the exposure blocking portion 125*a* may be exposed to the outer space Ou.

The louver member 120 includes a louver base 123 which supports the blocking portion 125. The blocking portion 125 may be fixed to the louver base 123. The louver base 123 may support both ends of the blocking portion 125. The louver base 123 includes a first base 123*a* which supports one end of the blocking portion 125. The louver base 123 includes a second base 123*b* which supports the other end of the blocking portion 125. The louver base 123 rotates integrally with the blocking portion 125. One end of both ends in the direction of each of the louver rotation axes Os, Os1, and Os2 is supported by the first base 123*a* and the other end is supported by the second base 123*b*.

The louver base 123 partitions both ends of the through-channel 127 in the direction of each of the louver rotation axes Os, Os1, and Os2.

The louver base 123 includes a corner 123*c*1 disposed on a boundary between the exposure blocking portion 125*a* and the louver base 123. The corner 123*c*1 is formed to correspond to the shape of the exposure blocking portion 125*a*. The corner 123*c*1 includes a curve recessed in a direction close to the louver rotation axes Os, Os1, and Os2. The corner 123*c*1 includes a curve corresponding to the shape of the recessed groove of the exposure blocking portion 125*a*.

The louver base 123 includes a corner 123*c*2 disposed on a boundary between the outer opening portion 127*a* and the louver base 123. The corner 123*c*12 is formed to correspond to the shape of the outer opening portion 127*a*. The corner 123*c*2 includes a curve recessed in a direction close to the louver rotation axes Os, Os1, and Os2. The corner 123*c*2 includes a curve corresponding to the shape of the recessed groove of the exposure blocking portion 125*a*. The corner 123*c*2 includes a curve having a shape corresponding to the corner 123*c*1.

The louver member 120 includes a louver shaft portion 121 disposed on the louver rotation axes Os, Os1, and Os2 of the louver base 123. The louver shaft portion 121 provides the functions of the louver rotation axes Os, Os1, and Os2.

In order to provide the functions of the louver rotation axes Os, Os1, and Os2, for example, a louver shaft portion, which is a separate part having as a shaft, may be disposed to connect the louver member 120 and the door 15 to each other, and as another example, a protrusion protruding along the louver rotation axes Os, Os1, and Os2 is formed in one of the louver member 120 and the door 15, and a groove in which the protrusion is rotatably inserted may be formed in the other thereof. In the present embodiment, a protrusion protruding along the louver rotation axes Os, Os1, and Os2 is formed on the first shaft portion 121*a* of the louver member 120 and inserted into the groove of the door 15. Moreover, a groove is formed in the second shaft portion 121*b* of the louver member 120, and a protrusion formed along the louver rotation axes Os, Os1, and Os2 of the door 15 is inserted into the groove of the second shaft portion 121*b*.

The louver shaft portion 121 includes the first shaft portion 121*a* disposed at one end of both ends in the extension direction of each of the louver rotation axes Os, Os1, and Os2 and the second shaft portion 121*b* disposed at the other end thereof. The first shaft portion 121*a* is disposed on the first base 123*a*. The second shaft portion 121*b* is disposed on the second base 123*b*. The first shaft portion 121*a* forms a rotation protrusion protruding along the louver rotation axes Os, Os1, and Os2. The first shaft portion 121*a* is rotatably inserted into a groove (not illustrated) of the door 15. The second shaft portion 121*b* forms a rotation groove recessed along the louver rotation axes Os, Os1, and Os2. The protrusion (not illustrated) of the door 15 is rotatably inserted into the groove of the second shaft portion 121*b*.

Referring to FIGS. 12 to 16, a plurality of the moving members 150 and 150' may be provided. The plurality of moving members 150*a* and 150*b* (150*a*', 150*b*') operated by one drive assembly 160 or 160' may be provided. A pair of moving members 150*a* and 150*b* (150*a*' and 150*b*') operated by one drive assembly 160 or 160' may be provided. The pair of moving members 150*a* and 150*b* (150*a*' and 150*b*') corresponds to the pair of louver members 120*a* and 120*b*. The pair of moving members 150*a* and 150*b* (150*a*' and 150*b*') may include the first moving members 150*a* and 150*a*' and the second moving members 150*b* and 150*b'*.

The pair of moving members 150*a* and 150*b* (150*a*' and 150*b*') respectively operates the pair of louver members 120*a* and 120*b* as the moving members move in directions opposite to each other. The first moving members 150*a* and 150*a*' operate the first louver member 120*a*, and the second moving members 150*b* and 150*b*' operate the second louver member 120*b*. The first moving members 150*a* and 150*a*' and the second moving members 150*b* and 150*b*' may be provided to be operated simultaneously by one drive assembly 160 or 160'.

The moving members 150 and 150' may be disposed to be linearly movable relative to the cabinet 10. The moving members 150 and 150' may move in a predetermined direction to rotate the louver member 120. In both directions of the linear movement of each of the moving members 150 and 150', a direction in which the through-channel 127 of the corresponding louver member 120 operates to be changed from the closed state to the open state is defined as the moving direction Mp1, and a direction in which the through-channel 127 of the corresponding louver member 120 operates to be changed from the open state to the closed state is defined as a direction Mr1 opposite to the moving direction.

The moving direction Mp1 may be preset in a direction cross the louver rotation axes Os, Os1, and Os2. The moving direction Mp1 and louver rotation axes Os, Os1, and Os2 may be preset vertically. The moving direction Mp1 may be preset in a direction away from the main drive members 161 and 161'.

The direction Mp1 and the direction Mr1 of one of the moving members 150 and 150' are directions opposite to each other. The moving directions Mp1 of each of the pair of moving members 150*a* and 150*b* (150*a*' and 150*b*') may be preset in directions opposite to each other. In this case, the directions Mr1 of each of the pair of moving members 150*a* and 150*b* (150*a*' and 150*b*') are also preset in directions opposite to each other. When the pair of moving members 150*a* and 150*b* (150*a*' and 150*b*') moves in each moving direction Mp1, the pair of moving members 150*a* and 150*b* (150*a*' and 150*b*') may be provided to be away from each other.

Each of the moving members 150 and 150' may be formed in a bar shape as a whole. The moving members 150 and 150' may be formed to extend in the moving direction Mp1.

The moving members 150 and 150' include starting ends 151 and 151' which receive power from the drive assemblies 160 and 160'. The moving members 150 and 150' include a terminal end 155 which transmits power to the corresponding louver member 120. The moving members 150 and 150' include an extension portion 153 which extends to connect the starting ends 151 and 151' and the terminal end 155 to each other.

One end of both end portions of each of the moving members 150 and 150' forms the starting ends 151 and 151' and the other end thereof forms the terminal end 155. In both ends of the moving members 150 and 150', the starting ends 151 and 151' are disposed in a direction close to the drive assemblies 160 and 160', and the terminal end 155 is disposed in a direction close to the corresponding louver member 120. The starting end portions 151 and 151' of each of the pair of moving members 150*a* and 150*b* (150*a*' and 150*b*') may face each other.

Figure 16A:
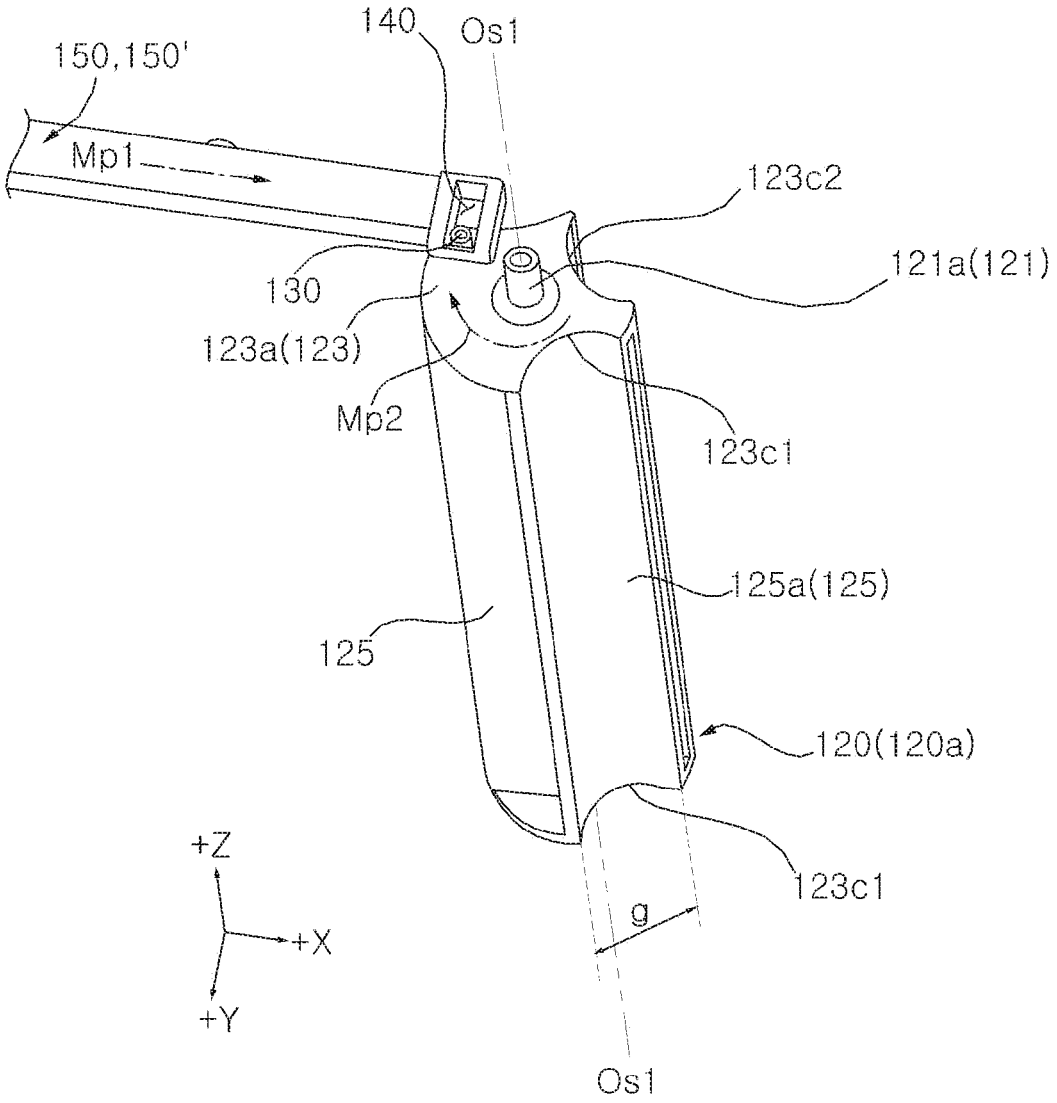
FIGS. 16*a* and 16*b* are partial elevation views illustrating operation mechanisms of a louver member 120 and the pair of moving members 150*a*' and 150*b*' of any one of FIG. 12 and FIG. 14.
Figure 16B:
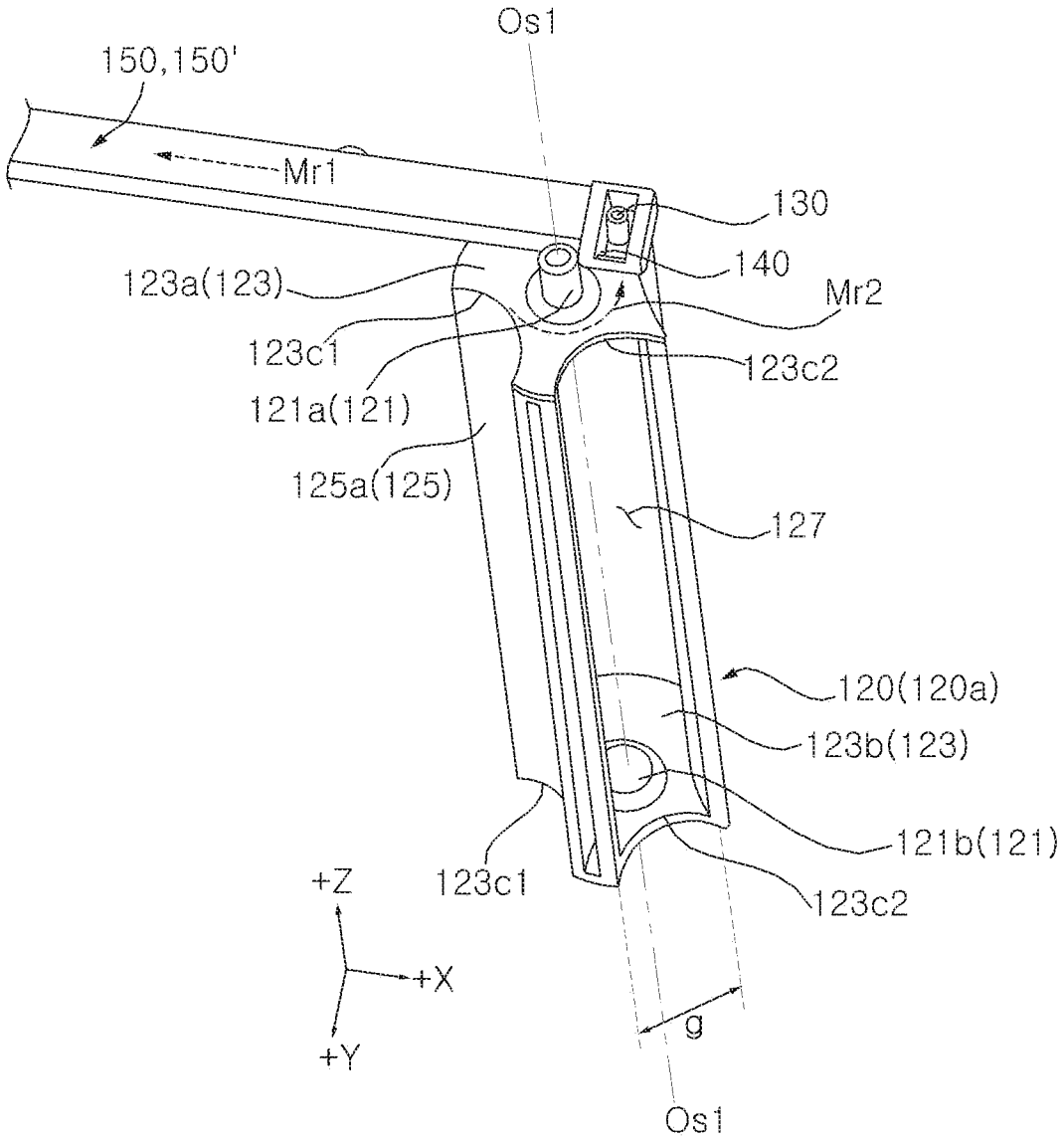

Referring to FIGS. 16*a* and 16*b*, the opening/closing modules 100 and 100' may include e transmission protrusion 130 formed on one of the moving members 150 and 150' and the corresponding louver member 120 and a transmission recess 140 formed on the other thereof. In any one of the louver member 120 and the moving members 150 and 150', the transmission protrusion 130 protruding at a position spaced apart from the corresponding louver rotation axes Os, Os1, and Os2 is formed. In the other of the louver member 120 and moving members 150 and 150', the transmission recess 140 into which the transmission protrusion 130 is inserted is formed. In the present embodiment, the transmission protrusion 130 is formed in the louver member 120 and the transmission recess 140 is formed in the moving members 150 and 150'. However, the present disclosure is not limited to this, the transmission protrusion 130 may be formed on the terminal end 155 of the moving members 150 and 150' and the transmission recess 140 may be formed on the louver base 123 of the louver member 120.

Preferably, the transmission recess 140 is formed longer than the transmission protrusion 130 in a direction across the louver rotation axes Os, Os1, and Os2 and the moving direction Mp1. In the present embodiment, the extension direction of each of the louver rotation axes Os, Os1, and Os2 is the Z-axis direction, the moving direction Mp1 is the X-axis direction, and a longitudinal direction of the transmission recess 140 is the Y-axis direction. The transmission recess 140 may be formed in a groove or hole shape. The delivery recess 140 may be formed in a slit shape. When moving members 150 and 150' linearly move in the directions Mp1 and Mr1, the transmission protrusion 130 moves relative to the transmission recess 140 in the longitudinal direction of the transmission recess 140 while the louver member rotates in the rotation directions Mp2 and Mr2. As the transmission protrusion 130 moves relative to the transmission recess 140 in the longitudinal direction (Y-axis direction), the moving members 150 and 150' rotate the louver member 120 while linearly moving without bending.

Movement trajectories of the moving members 150 and 150' are preset to be spaced apart from the corresponding louver rotation axes Os, Os1, and Os2. In a state where the moving members 150 and 150' move as far as possible in the direction Mr1 opposite to the moving direction, the connection point of the corresponding transmission protrusion 130 and the transmission recess 140 may be preset to be disposed at a position farther away from the direction Mr1 opposite to the moving direction than the positions of the corresponding louver rotation axes Os, Os1, and Os2. In a state where the moving members 150 and 150' move as far as possible in the moving direction Mp1, the connection point of the corresponding transmission protrusion 130 and the transmission recess 140 may be preset to be disposed at a position farther away from the moving direction Mp1 than the positions of the corresponding louver rotation axes Os, Os1, and Os2.

FIG. 16*a* illustrates a state where the moving member 150 is completed to move as far as possible in the direction Mr1 opposite to the moving direction, and in this case, the through-channel 127 of the louver member 120 is closed. FIG. 16*b* illustrates a state where the moving member 150 is completed to move as far as possible in the moving direction Mp1, and in this case, the through-channel 127 of the louver member 120 is open.

In the state of FIG. 16*a*, when the moving member 150 moves in the moving direction Mp1, the transmission protrusion 130 rotates in the louver rotation direction Mp2 about the louver rotation axes Os, Os1, and Os2 while the transmission protrusion 130 moves relative to the transmission recess 140 along the transmission recess 140. When the moving member 150 moves in the moving direction Mp1, the louver member 120 rotates in the louver rotation direction Mp2. When the louver member 120 rotates in the louver rotation direction Mp2, the through-channel 127 is changed from the closed state to the open state.

In the state of FIG. 16*b*, when the moving member 150 moves in the direction Mr1 opposite to the moving direction, the transmission protrusion 130 moves in the reverse rotation direction Mr2 of the louver rotation direction about the louver rotation axes Os, Os1, and Os2 while the transmission protrusion 130 moves relative to the transmission recess 140 along the transmission recess 140. When the moving member 150 moves in the direction Mr1 opposite to the moving direction, the louver member 120 rotates in the reverse rotation direction Mr2 of the louver rotation direction. When the louver member 120 rotates in the reverse rotation direction Mr2 of the louver rotation direction, the through-channel 127 is changed from the open state to the closed state.

Referring to FIGS. 12 to 15*b*, the drive assemblies 160 and 160' are provided to transmit the drive force of each of the motors 168 and 168' to the pair of moving members 150*a* and 150*b* (150*a*' and 150*b*'). The drive assemblies 160 and 160' convert the drive forces of the motors 168 and 168' to move the pair of moving members 150*a* and 150*b* (150*a*' and 150*b*') in opposite directions. The pair of moving members 150*a* and 150*b* (150*a*' and 150*b*') moves in opposite directions to each other, and thus, the corresponding through-channel 127 of the pair of louver members 120*a* and 120*b* can be changed from the closed state to the open state.

The drive assemblies 160 and 160' include main drive members 161 and 161' which are in contact with the moving members 150 and 150' and move the moving members 150 and 150' in the moving direction Mp1. The drive assemblies 160 and 160' include the motors 168 and 168'. The drive assemblies 160 and 160' may include power transmission units 163 and 163' which transmit the drive forces of the motors 168 and 168' to the main drive members 161 and 161'.

Meanwhile, the cabinet 10 includes a module support (not illustrated) which supports the opening/closing modules 100 and 100'. The module support may be disposed in the door 15. The module support supports the drive assemblies 160 and 160'. The module support guides the moving members 150 and 150' so that the moving members 150 and 150' can move only in the moving direction Mp1 and the direction Mr1 opposite to the moving direction. The module support part supports the louver member 120 so that the louver member 120 can rotate about the louver rotation axes Os, Os1, and Os2.

Figure 12:
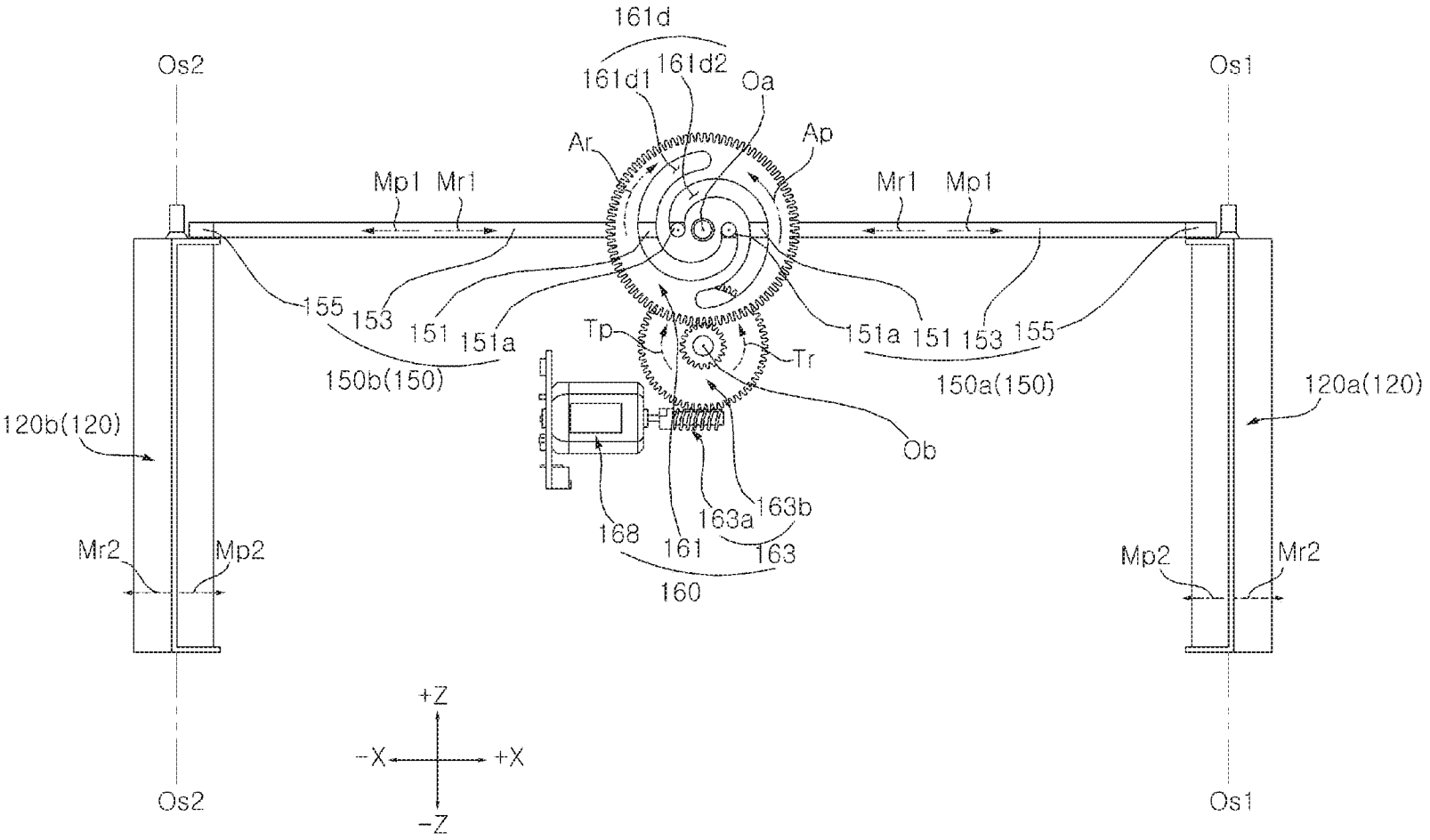
FIG. 12 is an elevation view when the opening/closing module 100 according to a first embodiment of FIG. 5 is viewed from the front.

Hereinafter, the opening/closing module 100 according to the first embodiment will be described with reference to FIGS. 12 to 13*b*.

The drive assembly 160 according to the first embodiment includes the main drive member 161 which moves the pair of moving members 150*a* and 150*b* away from each other or closer to each other according to the rotation direction of the motor 168. The main drive member 161 is provided to rotate around the predetermined main drive rotation axis Oa. The main drive rotation axis Oa extends in the direction across the moving direction Mp1. In the present embodiment, the main drive rotation axis Oa extends in the Y-axis direction. However, in another embodiment, the main drive rotation axis Oa may extend in the Z-axis direction or other direction as long as it is perpendicular to the moving direction Mp1. In order to minimize a thickness of the door 15 in a front-rear direction, preferably, the main drive rotation axis Oa is an axis extending in the front-rear direction.

The main drive member 161 is provided to be rotatable in the clockwise direction and the counterclockwise direction about the main drive rotation axis Oa. In the clockwise and counterclockwise directions about the main drive rotation axis Oa of the main drive member 161, a rotation direction in which the corresponding moving member 150 moves in the moving direction Mp1 is defined as a main rotation direction Ap, and a rotation direction in which the corresponding moving member 150 moves in the direction Mr1 opposite to the moving direction is defined as a reverse rotation direction Ar of the main rotation direction. The main drive member 161 is provided to rotate in the main rotation direction Ap or the reverse rotation direction Ar of the main rotation direction, depending on the rotation direction of the motor 168.

The main drive member 161 may include a plate-shaped rotating body 161*a* forming a thickness in an extension direction of the main drive rotation axis Oa. The rotating body 161*a* may be formed in a disc shape.

The main drive member 161 may include a rotating shaft portion 161*b* which is disposed at a central portion of the rotating body 161*a*. The rotation shaft portion 161*b* provides the function of the main drive rotation axis Oa. In order to provide the function of the main drive rotation axis Oa, for example, a separate part having a function as a shaft may be disposed to connect the door 15 and the main dive member 161 to each other, or as another example, a protrusion protruding along the main drive rotation axis Oa is formed in any one of the door 15 and the main drive member 161 may be formed, and a groove into which the protrusion is rotatably inserted may be formed in the other thereof. In the present embodiment, a hole is formed along the louver rotation axes Os, Os1, and Os2 in the rotating shaft portion 161*b*, and a shaft (not illustrated) connected to the cabinet 10 may be inserted into the hole of the rotating shaft portion 161*b*.

The main drive member 161 includes a driven unit 161*c* which receives power from the power transmission unit 163. The driven unit 161*c* includes a plurality of gear teeth formed along the circumference of the rotating body 161*a*. The driven unit 161*c* meshes with the main gear portion 163*b*1 of the second gear 163*b* to be described later and receives a rotational force.

The main drive member 161 comes into contact with the moving member 150 to form a cam groove 161*d* which transmits power to the moving member 150. The cam groove 161*d* may be formed in the rotating body 161*a*. The cam groove 161*d* is meant to encompass a groove or hole.

The cam groove 161*d* may extend to be gradually away from the main drive rotation axis Oa as the cam groove 161*d* goes in any one of the clockwise or counterclockwise directions about the main drive rotation axis Oa. The cam groove 161*d* extends to be gradually away from the main drive rotation axis Oa as the cam groove 161*d* goes in the reverse rotation direction Ar of the main rotation direction about the main drive rotation axis Oa. The cam groove 161*d* extends to be gradually closer to the main drive rotation axis Oa as the cam groove 161*d* goes in the main rotation direction Ap about the main drive rotation axis Oa.

The cam groove 161*d* may extend in a range of about 270° about the main drive rotation axis Oa. In the cam groove 161*d*, a first point which is an end in the main rotation direction Ap and a second point which is an end in the reverse rotation direction Ar of the main rotation direction are connected to each other and extend. A cam protrusion 151*a* to be described later is inserted into the cam groove 161*d* and moves relative to the cam groove 161*d* along the cam groove 161*d* when the main drive member 161 rotates. When the cam protrusion 151*a* is located at the first point of the cam groove 161*d*, the moving member 150 is completed to move as far as possible in the direction Mr1 opposite to the moving direction. When the cam protrusion 151*a* is located at the second point of the cam groove 161*d*, the moving member 150 is completed to move as far as possible in the moving direction Mp1.

The main drive member 161 may form a plurality of the cam grooves 161*d*. In the present embodiment, the main drive member 161 forms the pair of the cam grooves 161*d*1 and 161*d*2 corresponding to the pair of moving members 150*a* and 150*b*. The pair of the cam grooves 161*d*1 and 161*d*2 includes the first cam groove 161*d*1 into which the cam protrusion 151*a* of the first moving member 150*a* is inserted, and the second cam groove 161*d*2 into which the cam protrusion 151*a* of the second moving member 150*b* is inserted. The first cam groove 161*d*1 and the second cam groove 161*d*2 are formed to be spaced apart from each other. The first cam groove 161*d*1 and the second cam groove 161*d*2 are formed to be point symmetrically about the louver rotation axes Os, Os1, and Os2.

The drive assembly 160 may include the motor 168 having a motor shaft 168*a* protruding in the direction across the main drive rotation axis Oa. In the present embodiment, the motor shaft 168*a* protrudes laterally.

The drive assembly 160 includes a power transmission unit 163 having at least one gear which transmits the drive force of the motor 168 to the main drive member 161. The at least one gear rotates the main drive member 161.

The at least one gear may include the first gear 163*a* which rotates integrally with the motor shaft 168*a*. The first gear 163*a* may be fixed to the motor shaft 168*a*. The first gear 163*a* may include a worm gear.

The at least one gear may include the second gear 163*b* which meshes with the gear of the main drive member 161 and rotates the main drive member 161. The second gear 163*b* may rotate in engagement with the first gear 163*a*. The second gear 163*b* may be rotatably provided about the predetermined transmission rotation axis Ob. The transmission rotation axis Ob may be disposed to be parallel to the main drive rotation axis Oa. In the clockwise direction and the counterclockwise direction about the transmission rotation axis Ob of the second gear 163*b*, a direction in which the main drive member 161 rotates in the main rotation direction Ap is defined as a transmission forward rotation direction Tp, and a direction in which the main drive member 161 rotates in the reverse rotation direction Ar of the main rotation direction is defined as a transmission rotation direction Tp.

The second gear 163*b* may include a driven gear portion 163*b*2 forming gear teeth which mesh with the gear teeth of the first gear 163*a*. The driven gear portion 163*b*2 includes a plurality of gear teeth disposed along a circumferential direction about the transmission rotation axis Ob. The driven gear portion 163*b*2 forms a helical gear, and may mesh with a worm gear.

The second gear 163*b* may include a main gear portion 163*b*1 forming gear teeth which mesh with the gear teeth of the driven unit 161*c* of the main drive member 161. The main gear part 163*b*1 includes a plurality of gear teeth disposed along the circumferential direction about the transmission rotation axis Ob. The position of the main gear portion 163*b*1 may be closer to the transmission rotation axis Ob than the position of the driven gear portion 163*b*2.

The moving member 150 according to the first embodiment is provided to move in the moving direction Mp1 when the main drive member 161 rotates in the main rotation direction Ap. The moving member 150 is provided to move in the opposite direction Mr1 of the moving direction when the main drive member 161 rotates in the reverse rotation direction Ar of the main rotation direction. The pair of moving members 150*a* and 150*b* may be provided to be away from each other when the main drive member 161 rotates in the main rotation direction Ap. The pair of moving members 150*a* and 150*b* may be provided close to each other when the main drive member 161 rotates in the reverse rotation direction Ar of the main rotation direction. The moving direction Mp1 may be preset in a direction across the main drive rotation axis Oa.

The moving member 150 includes the cam protrusion 151*a* which is inserted into the cam groove 161*d*. The cam protrusion 151*a* may be formed at the starting end 151. The cam protrusion 151*a* may protrude in the direction perpendicular to the moving direction Mp1. The cam protrusion 151*a* may protrude in a direction parallel to the louver rotation axes Os, Os1, and Os2. The cam protrusion 151*a* moves integrally with the moving member 150 in the moving direction Mp1 or in the direction Mr1 opposite to the moving direction. However, the cam protrusion 151*a* moves relative to the cam groove 161*d* along the extension direction of the cam groove 161*d*.

Figure 13A:
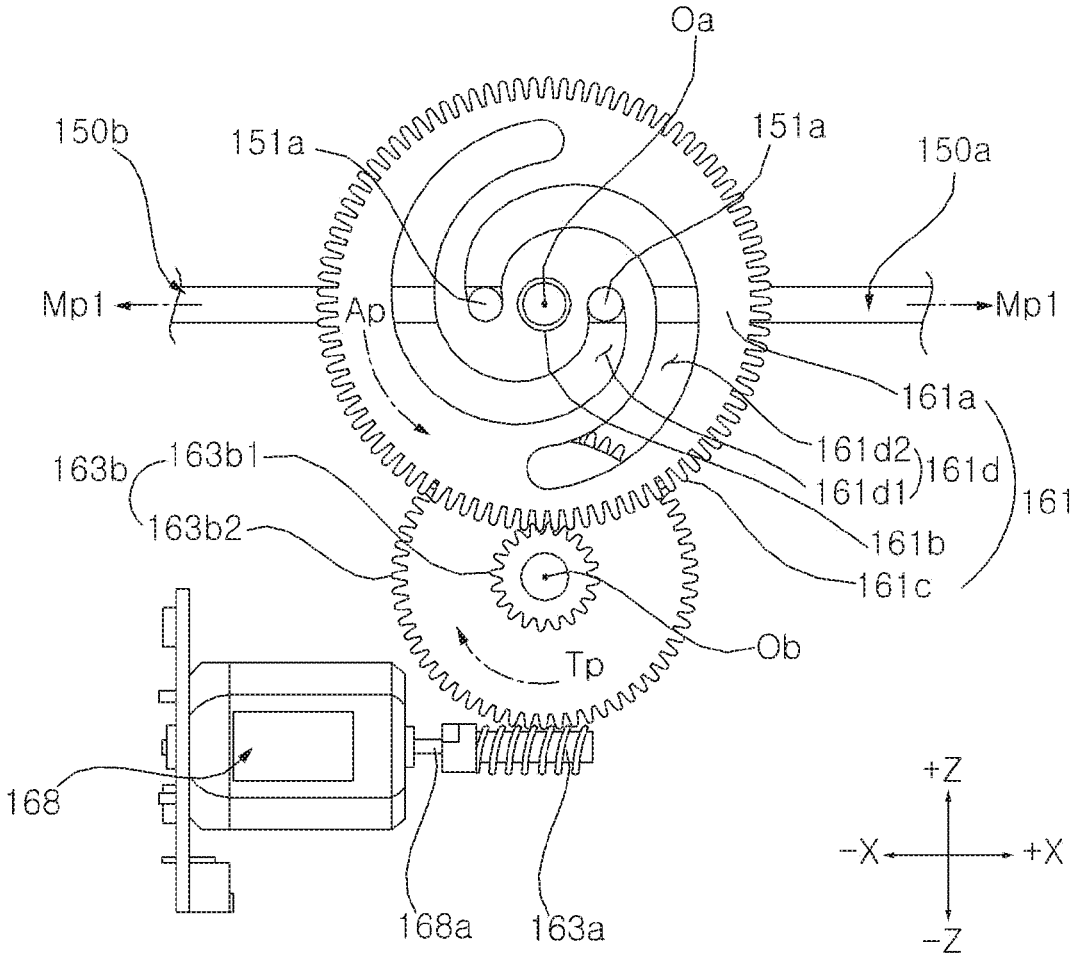
FIGS. 13*a* and 13*b* are partial elevation views illustrating operation mechanisms of a drive assembly 160 and a pair of moving members 150*a* and 150*b* (150*a*' and 150*b*') of FIG. 12.

FIG. 13*a* illustrates a state where the moving member 150 is completed to move as far as possible in the direction Mr1 opposite to the moving direction. FIG. 13*b* illustrates a state where the moving member 150 is completed to move as far as possible in the moving direction Mp1.

In the state of FIG. 13*a*, when the motor shaft 168*a* rotates in the forward direction, the second gear 163*b* rotates in the transmission forward rotation direction Tp by the forward rotation of the first gear 163*a*. When the second gear 163*b* rotates in the forward rotation direction Tp, the main drive member 161 rotates in the main rotation direction Ap. When the main drive member 161 rotates in the main rotation direction Ap, the cam groove 161*d* rotates in the main rotation direction Ap. When the cam groove 161*d* rotates in the main rotation direction Ap, the cam protrusion 151*a* rotates relative to the cam groove 161*d* in the reverse rotation direction Ar of the main rotation direction. When the main drive member 161 rotates in the main rotation direction Ap, the moving member 150 moves in the moving direction Mp1. When the cam protrusion 151*a* is located at the second point of the cam groove 161*d*, the motor shaft 168*a* is restrained from further rotating in the forward direction.

Figure 13B:
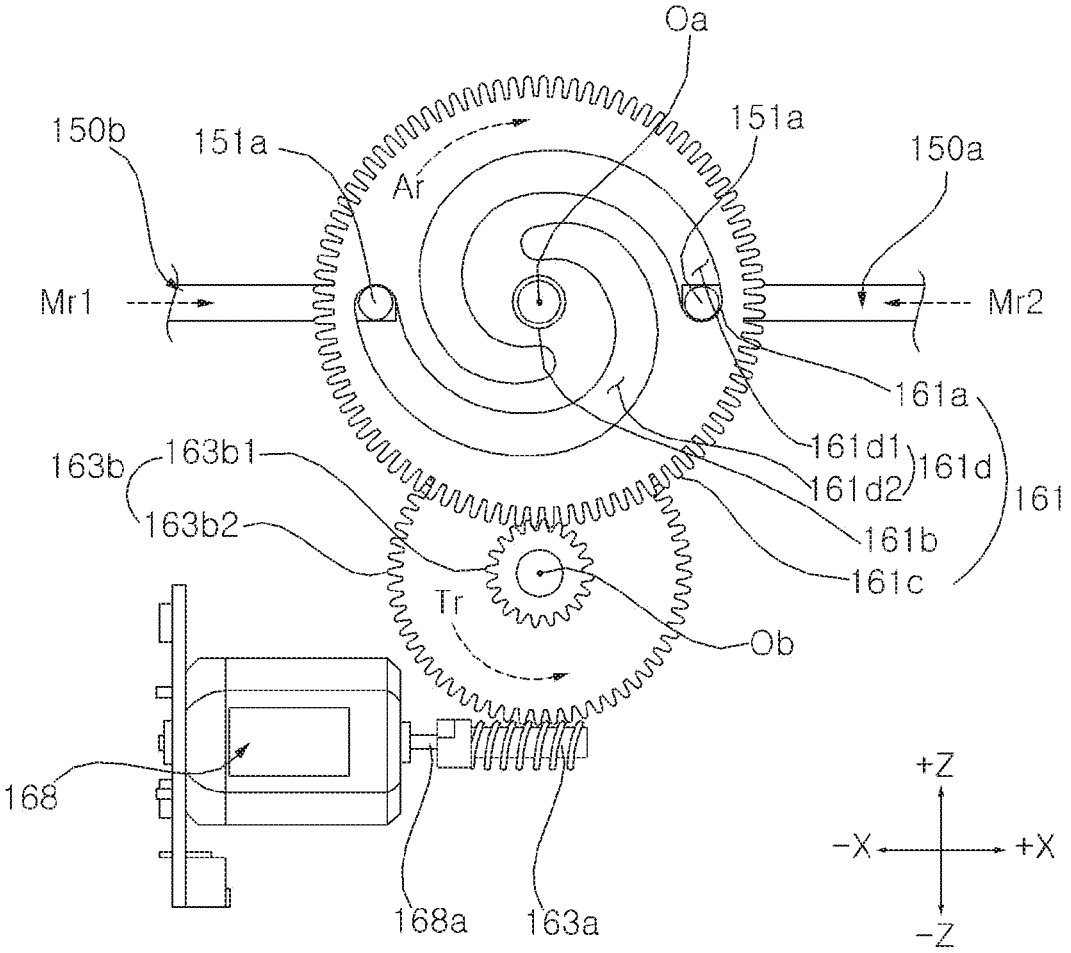

In the state of FIG. 13*b*, when the motor shaft 168*a* rotates in a reverse direction, the second gear 163*b* rotates in the transmission reverse rotation direction Tr by the reverse rotation of the first gear 163*a*. When the second gear 163*b* rotates in the transmission reverse rotation direction Tr, the main drive member 161 rotates in the reverse rotation direction Ar of the main rotation direction. When the main drive member 161 rotates in the reverse rotation direction Ar of the main rotation direction, the cam groove 161*d* rotates in the reverse rotation direction Ar of the main rotation direction. When the cam groove 161*d* rotates in the reverse rotation direction Ar of the main rotation direction, the cam protrusion 151*a* rotates relative to the cam groove 161*d* in the main rotation direction Ap. When the main drive member 161 rotates in the main rotation direction Ap, the moving member 150 moves in the direction Mr1 opposite to the moving direction. When the cam protrusion 151*a* is located at the first point of the cam groove 161*d*, the motor shaft 168*a* is restrained from further rotating in the reverse direction.

Figure 14:
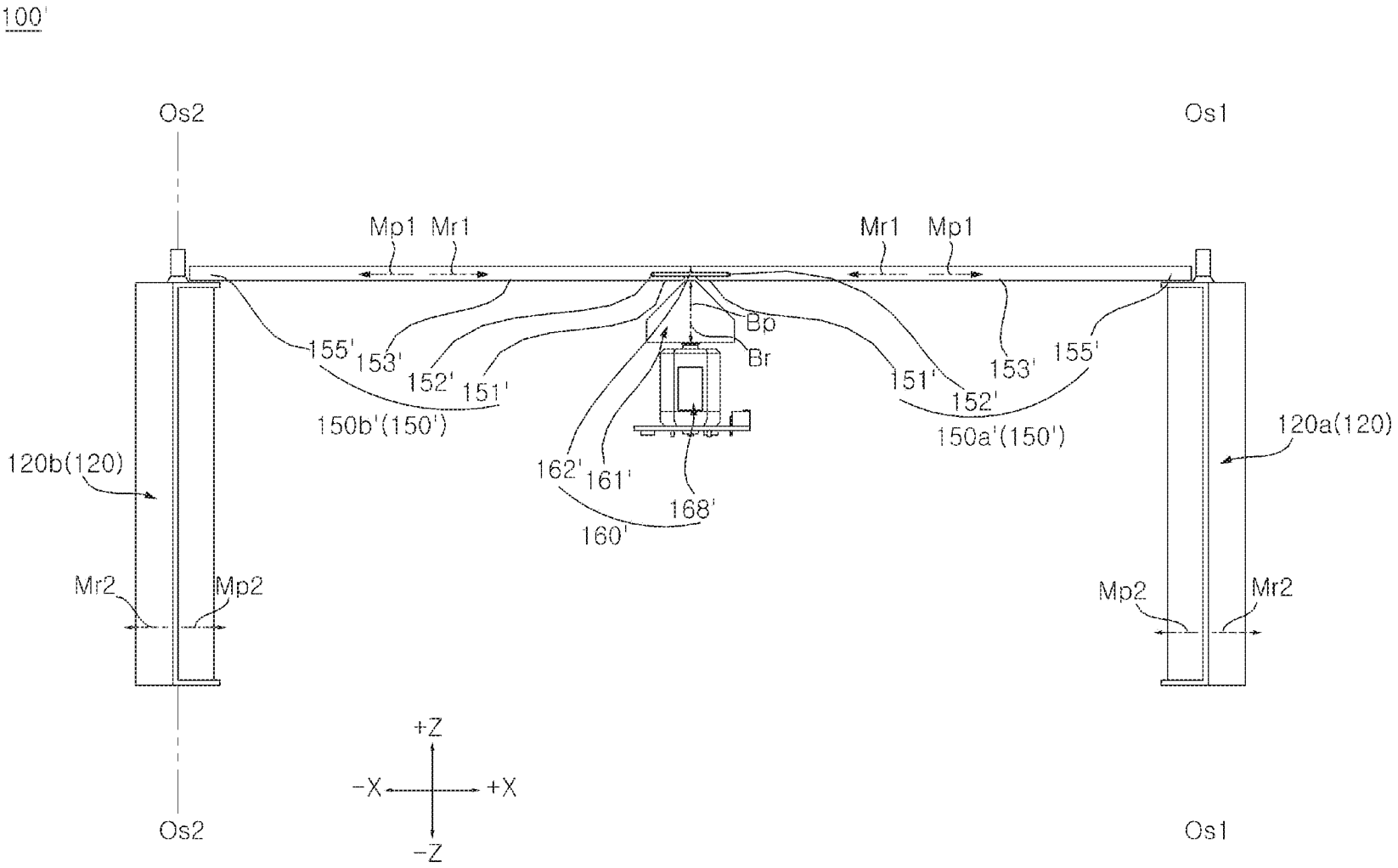
FIG. 14 is an elevation view when the opening/closing module 100' according to a second embodiment of FIG. 5 is viewed from the front, and FIG. 14 conceptually illustrates only a connection relationship of both ends of an elastic member 162'.

Hereinafter, the opening/closing module 100' according to the second embodiment will be described with reference to FIGS. 14 to 15*b*.

The drive assembly 160' according to the second embodiment includes the main drive member 161' which moves the pair of moving members 150*a*' and 150'*b* away from each other according to the rotation direction of the motor 168'. The main drive member 161' pushes the moving member 150' in the moving direction Mp1 when the main drive member 161' moves in the predetermined main drive direction Bp. The main drive direction Bp may be a direction across the moving direction Mp1. In the present embodiment, the main drive direction Bp is the up (+Z) direction, but is not limited to this.

The main drive member 161' is provided to be movable linearly. In both directions of the linear movement of the main drive member 161', a direction in which the moving member 150' moves in the moving direction Mp1 is defined as a main drive direction Bp and a direction in which the moving member 150' moves in a direction Mr1 opposite to the moving direction is defined as a direction Br opposite to the main drive direction. The main drive member 161' is provided to be movable in the predetermined main drive direction Bp or the direction Br opposite to the main drive direction according to the rotation direction of the motor 168'.

The main drive member 161' includes a driven unit 161*c*' which receives power from the power transmission unit 163'. The driven unit 161*c*' may form a screw groove. The screw groove may be formed to be recessed in the main drive direction Bp on the surface of the main drive member 161'. The screw groove may be formed on a side of the main drive member 161' in the direction Br opposite to the main drive direction.

The main drive member 161' is restrained from being rotated. However, the main drive member 161' is provided to be movable linearly in the main drive direction Bp or in the direction Br opposite to the main drive direction. The screw groove engages with the screw gear to be described later. When the screw gear rotates, the screw gear rotates relative to the screw groove, and the screw gear moves out of the screw groove or the screw gear enters the screw groove. When the screw gear moves out of the screw groove, the main drive member 161' moves in the main drive direction Bp. When the screw gear enters the screw groove, the main drive member 161' moves in a direction Br opposite to the main drive direction.

The main drive member 161' may include the top portion 161*a*' inserted into between the pair of moving members 150*a*' and 150*b*' in a state (refer to FIGS. 14 and 15*a*) where the main drive member 161' moves as far as possible in the direction Br opposite to the main drive direction. A pair of sliding portions 151*b*' of the pair of moving members 150*a*' and 150*b*' forms a gap in the direction Br opposite to the main drive direction, and the top portion 161*a*' is inserted into the gap. Accordingly, when the main drive member 161' moves in the main drive direction Bp, the pair of moving members 150*a*' and 150*b*' can be naturally moved away from each other.

The main drive member 161' includes a base portion 161*b*' disposed on the side in the direction Br opposite to the main drive direction. The top portion 161*a*' and the base portion 161*b*' may be integrally formed with each other. The driven unit 161*c*' may be formed in the base portion 161*b*'. The main drive member 161' may have a shape which is narrowed in the moving direction Mp1 as the entire main drive member 161' goes from the base portion 161*b* to the top portion 161*a*'.

A relationship between the main drive member 161' and the moving member 150' is as follows. The main drive member 161' includes a pressing portion 161*d*' which forms an inclined surface which is in contact with the moving member 150' facing a direction between the main drive direction Bp and the moving direction Mp1. The inclined surface of the pressing portion 161*d*' has a surface whose height decreases in the direction Br opposite to the main drive direction as the inclined surface goes in the moving direction Mp1. When the main drive member 161' moves in the main drive direction Bp, the sliding portion 151*b*' of the moving member 150' moves relative to the main drive member 161' obliquely along the inclined surface. When the sliding portion 151*b*' of the moving member 150' moves relative to the main drive member 161' obliquely along the inclined surface, the moving member 150' moves in the moving direction Mp1.

A relationship between the main drive member 161' and the pair of moving members 150*a*' and 150*b*' is as follows. The main drive member 161' forms the pair of pressing portions 161*d*1' and 161*d*2' corresponding to the pair of moving members 150*a*' and 150*b*'. The first pressing portion 161*d*1' has the first inclined surface 161*d*1' which moves away in the direction Br opposite to the main drive direction from the top portion 161*a*' as the first inclined surface 161*d*1' moves in the moving direction Mp1 of the first moving member 150*a*' in the top portion 161*a*'. The second pressing portion 161*d*2' has the second inclined surface 161*d*2' which moves away in the direction Br opposite to the main drive direction from the top portion 161*a*' as the second inclined surface 161*d*2' moves in the moving direction Mp1 of the second moving member 150*b*' in the top portion 161*a*'. When the main drive member 161' moves in the main drive direction Bp, the sliding portion 151*b*' of the first moving member 150*a*' obliquely moves relative to the first inclined surface 161*d*1 'along the first inclined surface 161*d*1', and the sliding portion 151*b*' of the second moving member 150*b*' obliquely moves relative to the second inclined surface 161*d*2' along the second inclined surface 161*d*2'. When the main drive member 161' moves in the main drive direction Bp, the pair of moving members 150*a*' and 150*b*' moves away from each other.

The drive assembly 160' further includes the elastic member 162' which is provided to be elastically deformed when the moving member 150' moves in the moving direction Mp1. The elastic member 162' is provided to be elastically restored when the moving member 150' moves in the direction Mr1 opposite to the moving direction. The elastic member 162' may be a spring or the like.

A relationship between the main drive member 161' and the moving member 150' is as follows. One end of the elastic member 162' is fixed to the moving member 150'. When the moving member 150' moves in the moving direction Mp1, the elastic member 162' is elastically stretched. When the main drive member 161' moves in the main drive direction Bp, the moving member 150' is pushed in the moving direction Mp1 by a force larger than an elastic force of the elastic member 162', and thus, the moving member 150' moves in the moving direction Mp1. When the main drive member 161' moves in the direction Br opposite to the main drive direction, the moving member 150' is moved in the direction Mr1 opposite to the moving direction by the elastic force of the elastic member 162'. When the moving member 150' moves in the direction Mr1 opposite to the moving direction, the sliding portion 151*b*' of the moving member 150' slides along the inclined surface of the pressing portion 161*d*'.

A relationship between the main drive member 161' and the pair of moving members 150*a*' and 150*b*' is as follows. The pair of moving members 150*a*' and 150*b*' are pulled to each other by the elastic member 162'. As the main drive member 161' moves in the main drive direction Bp and the pair of moving members 150*a*' and 150*b*' moves gradually away from each other, the elastic member 162' can pull a pair of moving members 150*a*' and 150*b*' with a greater force. When the main drive member 161' moves in the direction Br opposite to the main drive direction, the pair of moving members 150*a*' and 150*b*' moves closer to each other by the elastic force of the elastic member 162'.

The drive assembly 160' may include the motor 168 ' having a motor shaft 168*a*' which protrudes in the main drive direction Bp. In the present embodiment, the motor shaft 168*a*' protrudes upward.

The drive assembly 160' may include the power transmission unit 163' which transmits power to move the main drive member 161'. The power transmission unit 163' may include a screw gear 163' which rotates about the rotation axis parallel to the main drive direction Bp by the drive force of the motor 168'. The screw gear 163' may be fixed to the motor shaft 168'. The screw gear 163' may rotate integrally with the motor shaft 168'. The screw gear 163' is inserted into the screw groove of the main drive member 161' and can rotate relative to the screw groove.

The moving member 150' according to the second embodiment is provided to move in the moving direction Mp1 when the main drive member 161' moves in the main drive direction Bp. The moving member 150' is provided to move in the direction Mr1 opposite to the moving direction when the main drive member 161' moves in the direction Br opposite to the main drive direction. The pair of moving members 150*a*' and 150*b*' may be provided away from each other when the main drive member 161' moves in the main drive direction Bp. The pair of moving members 150*a*' and 150*b*' may be provided closer to each other when the main drive member (') moves in the direction Br opposite to the main drive direction. The moving direction Mp1 may be preset in the direction across the main drive direction Bp.

The moving member 150' includes the sliding portion 151*b*' which is in contact with the pressing portion 161*d*'. The sliding portion 151*b*' is in contact with the inclined surface of the pressing portion 161*d*' and is slidably provided along the inclined surface. The sliding portion 151*b*' may be formed on the starting end 151'. The sliding portion 151*b*' may form a beveled surface looking in the direction between the direction Br opposite to the main drive direction and the direction Mr1 opposite to the moving direction.

Figure 15A:
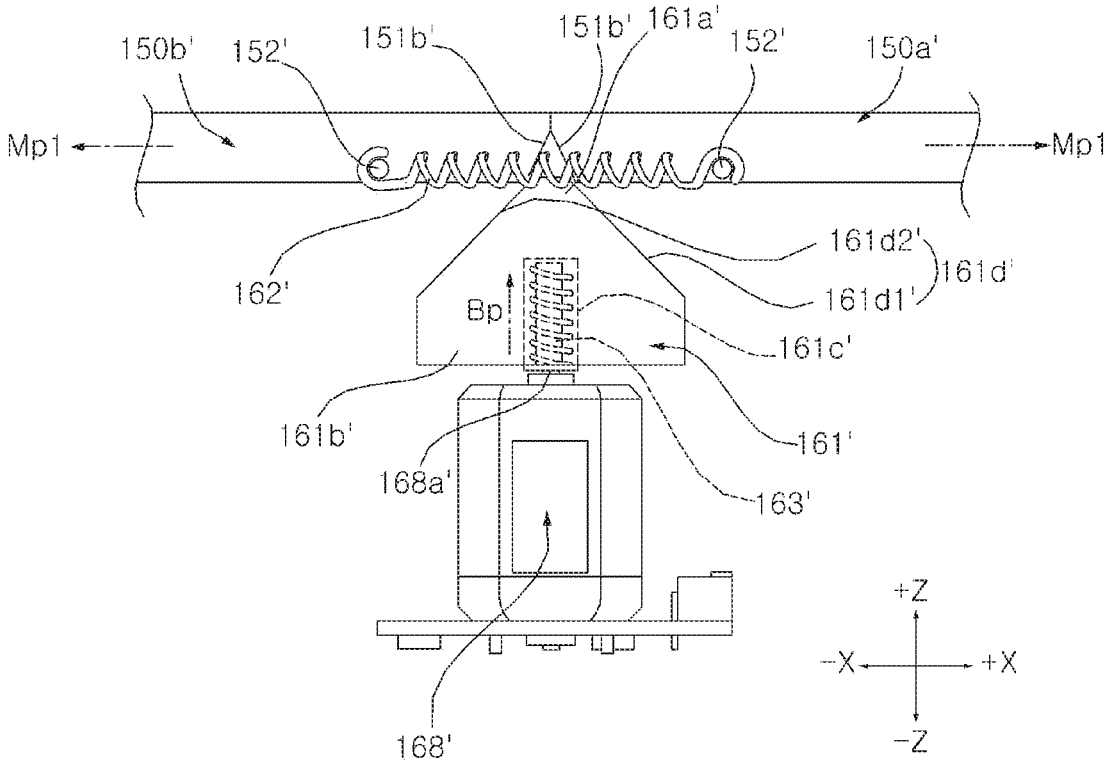
FIGS. 15*a* and 15*b* are partial elevation views illustrating operation mechanisms of a drive assembly 160' and the pair of moving members 150*a*' and 150*b*' of FIG. 14.

Referring to FIG. 15*a*, in a state where each of the pair of moving members 150*a*' and 150*b*' is completed to move as far as possible in the direction Mr1 opposite to the moving direction, a distal end of the sliding portion 151*b*' of the first moving member 150*a*' in the main drive direction Bp may come into contact with a distal end of the sliding portion 151*b*' of the second moving member 150*b*' in the main drive direction Bp.

The moving member 150' includes an elastic member support portion 152' supporting the end of the elastic member 162'. One end of the elastic member 162' may be fixed to the elastic member support 152' of the first moving member 150*a*', and the other end of the elastic member 162' may be fixed to the elastic member support 152 of the second moving member 150*b*'.

FIG. 15*a* illustrates a state in which the moving member 150 is completed moves as far as possible in the direction Mr1 opposite to the moving direction. FIG. 15*b* illustrates a state in which the moving member 150 is completed to move as far as possible in the moving direction Mp1.

In the state of FIG. 15*a*, when the motor shaft 168' rotates in the forward direction, the screw gear 163' is withdrawn from the screw groove of the main drive member 161' by the forward rotation of the screw gear 163'. During the forward rotation of the screw gear 163', the main drive member 161' moves in the main drive direction Bp. When the main drive member 161' moves in the main drive direction Bp, the moving member 150' moves in the moving direction Mp1 while the sliding member 151*b*' of the moving member 150' slides along the inclined surface of the pressing portion 161*d*'. The module support may include a limit structure that limits the maximum movement range of the main drive direction of the main drive member 161'. When the main drive member 161' come into contact with the limit structure, the motor shaft 168' is restrained from further rotating in the forward direction.

Figure 15B:
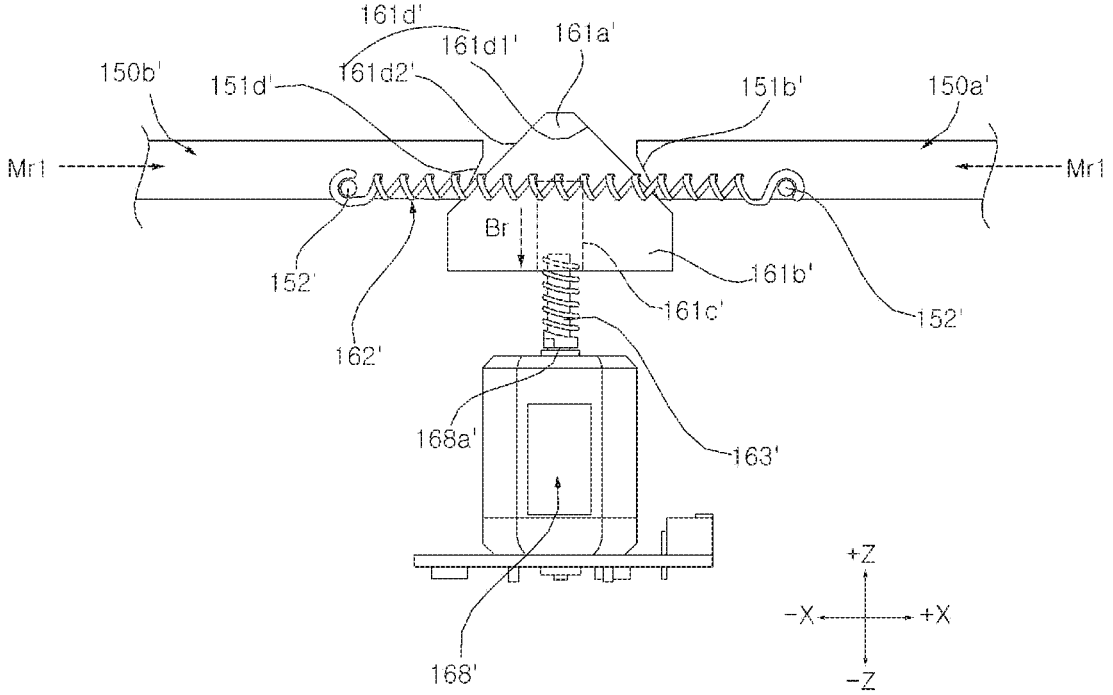

In the state of FIG. 15*b*, when the motor shaft 168' rotates in the reverse direction, the screw gear 163' enters the screw groove of the main drive member 161' by the reverse rotation of the screw gear 163'. When the screw gear 163' is rotated in the reverse direction, the main drive member 161' moves in the direction Br opposite to the main drive direction. When the main drive member 161' moves in the direction Br opposite to the main drive direction, the moving member 150' moves in the direction Mr1 opposite to the moving direction while the sliding portion 151*b'* of the moving member 150' slides along the inclined surface of the pressing portion 161*d'* by the elastic force of the elastic member 162'. When the screw gear 163' enter the end of the screw groove, the motor shaft 168' is restrained from further rotating in the reverse direction.

Hereinafter, a plurality of modes will be described in detail with reference to FIGS. 4 and 11*a* to 11*c*. The controller 2 is provided to select any one of a plurality of preset modes. The plurality of modes include a preset circulation mode and ventilation mode. The controller 2 can control various parts in the clothing treatment apparatus 1 according to the selected mode.

The plurality of modes may be classified according to whether the outside air flows in or out. The plurality of modes may include at least one circulation mode and at least one ventilation mode.

In the circulation mode (first circulation mode, second circulation mode), the controller 2 perform a control to operate the fan 50. In the circulation mode, the controller 2 controls the valve module 70 and the opening/closing modules 100 and 100' such that the inside air channels Pa and Pb among the plurality of channels are selected.

In the circulation mode, the controller 2 performs a control so that the valve module 70 opens the inside air channels Pa and Pb and the opening/closing modules 100 and 100' blocks the through-channel 127.

In the circulation mode, the inside air channels Pa and Pb are selected. In the circulation mode, the controller 2 performs a control so that the outside air inlet channel 127 and the exhaust outlet channel 127 are closed. That is, the outside air opening/closing module 100*a* closes the outside air inlet channel 127 and the exhaust opening/closing module 100*b* closes the exhaust outlet channel 127. In the circulation mode, the valve module 70 opens at least one of the valves 70*a* and 70*b* so that the air in the treatment space 10*s* can flow into the shared section P0.

In the ventilation mode, the controller 2 controls the fan 50 so that the fan 50 is operated. In the ventilation mode, the controller 2 controls the valve module 70 and the opening/closing modules 100 and 100' such that the outside air channel Pc is selected from the plurality of channels.

In the ventilation mode, the controller 2 performs a control so that the valve module 70 blocks the inside air channels Pa and Pb and the opening/closing modules 100 and 100' open the through-channel 127.

When the ventilation mode is selected, the outside air channel Pc is selected. In the ventilation mode, the controller 2 performs a control so that the outside air inlet channel 127 and the exhaust outlet channel 127 are open. That is, the outside air opening/closing module 100*a* opens the outside air inlet channel 127 and the exhaust opening/closing module 100*b* opens the exhaust outlet channel 127. In the ventilation mode, the valve module 70 closes all the valves 70*a* and 70*b* so that air in the treatment space 10*s* does not flow into the shared section P0.

The at least one circulation mode may be classified into a first circulation mode and a second circulation mode, depending on whether air is filtered by the filter unit 95.

The user performs an input through the input unit 3, and thus, the plurality of modes may be selected. The plurality of modes may be selected and performed differently for each time section in one clothing processing process. The plurality of modes may be selected and performed differently based on information sensed by the sensing unit 4.

In the first circulation mode, the controller 2 performs a control so that the steam module 7 injects steam into the treatment space 10*s*. In the first circulation mode, the controller 2 performs the fan 50 so that the fan 50 is operated. In the first circulation mode, the controller 2 controls the valve module 70 and the open modules 100 and 100' such that the first inside air channel Pa is selected from the plurality of channels. In the first circulation mode, the controller 2 performs a control so that first valve 70*a* is opened and the second valve 70*b* is closed. In the first circulation mode, the controller 2 performs a control so that the outside air opening/closing module 100*a* and exhaust opening/closing module 100*b* close the outside air inlet channel 127 and exhaust outlet channel 127, respectively. In the first circulation mode, the controller 2 may perform a control so that the hanger module 30 is vibrated. According to the first circulation mode, the steam can be efficiently supplied to clothing.

In the second circulation mode, the controller 2 performs a control so that the steam module 7 does not inject the steam into the treatment space 10*s*. In the second circulation mode, the controller 2 performs a control so that the fan 50 is operated. In the second circulation mode, the controller 2 controls the valve module 70 and the opening modules 100 and 100' so that the second inside air channel Pb is selected from the plurality of channels. In the second circulation mode, the controller 2 performs a control so that the first valve 70*a* is closed and the second valve 70*b* is opened. In the second circulation mode, the controller 2 performs a control so that the outside air opening/closing module 100*a* and the exhaust opening/closing module 100*b* close the outside air inlet channel 127 and exhaust outlet channel 127, respectively. In the second circulation mode, the controller 2 may perform a control so that the hanger module 30 is vibrated. According to the second circulation mode, foreign substances attached to clothing can be effectively removed.

In the first circulation mode and the second circulation mode, the controller 2 may perform a control so that the hanger module 30 has different vibration patterns. For example, the controller 2 may perform a control so that the hanger module 30 vibrates relatively slowly in the first circulation mode, and may perform a control so that the hanger module 30 vibrates relatively quickly in the second circulation mode.

In the ventilation mode, the controller 2 can perform a control so that the steam module 7 does not inject steam into the treatment space 10*s*. In the ventilation mode, the controller 2 perform a control so that the fan 50 operate is operated. In the ventilation mode, the controller 2 controls the valve module 70 and the opening modules 100 and 100' so that the outside air channel Pc is selected from the plurality of channels. In the ventilation mode, the controller 2 performs a control so that the first valve 70*a* is closed and the second valve 70*b* is closed. In the ventilation mode, the controller 2 performs a control so that the outside air opening/closing module 100*a* and the exhaust opening/closing module 100*b* open the outside air inlet channel 127 and the exhaust outlet channel 127, respectively. In the ventilation mode, the controller 2 can perform a control so that the hanger module 30 does not vibrate. According to the ventilation mode, it is possible to efficiently remove moisture or odor components contained in the clothing. In addition, in the ventilation mode, dust or odor components in the treatment space 10*s* are discharged to the outside to improve the quality of the space in which clothing is accommodated.

What is claimed is:

1. A clothing treatment apparatus comprising:

a cabinet having a treatment space for accommodating clothing therein;

a door rotatably connected to the cabinet, configured to open and close the treatment space, and having (i) a door inner space therein, (ii) an inner opening toward an inside of the cabinet, and (iii) an outer opening toward an outside of the cabinet;

a louver member disposed in the door inner space, being rotatable about a predetermined louver rotation axis, having a through-channel configured to connect or disconnect the inner opening and the outer opening depending on a rotation of the louver member;

a moving member disposed in the door inner space, configured to move in width direction of the door, and engaged with the louver member to rotate the louver member; and a drive assembly provided in the door inner space, and generating a drive force to move the moving member.

2. The clothing treatment apparatus according to claim 1, wherein the door comprises:

a door inner frame; and a door outer frame disposed to face the door inner frame to form a gap with the door inner frame, and wherein the gap forms the door inner space.

3. The clothing treatment apparatus according to claim 2, wherein the door further comprises a door side frame disposed at an edge of the door, wherein the inner opening is formed between the door inner frame and the door side frame, and wherein the outer opening is formed between the door outer frame and the door side frame.

4. The clothing treatment apparatus according to claim 3, wherein the inner opening and the outer opening are formed in a perpendicular direction to each other.

5. The clothing treatment apparatus according to claim 1, wherein the inner opening and the outer opening are provided at a side of the door.

6. The clothing treatment apparatus according to claim 1, wherein, when the louver member disconnects the inner opening and the outer opening, the through-channel connects either the inner opening and the outer opening to the door inner space.

7. The clothing treatment apparatus according to claim 1, wherein the louver member comprises:

a blocking portion forming at least a portion of the through-channel;

a louver base supporting the blocking portion;

a louver shaft portion disposed on the louver rotation axis of the louver base; and a transmission protrusion protruding from the louver base, protruding at a position spaced apart from the louver rotation axis, and engaged with the moving member.

8. The clothing treatment apparatus according to claim 7, wherein the moving member comprises a transmission recess which the transmission protrusion is inserted into, and wherein the transmission recess is formed to be longer than the transmission protrusion in a direction across the louver rotation axis and the width direction of the door.

9. The clothing treatment apparatus according to claim 1, further comprising a machine room disposed under the treatment space in the cabinet, treating air in the treatment space.

10. The clothing treatment apparatus according to claim 9, wherein the louver member comprises:

a first louver member configured to communicating the outer space of the cabinet and the treatment space; and a second louver member configured to communicating the outer space of the cabinet and the machine room.

11. The clothing treatment apparatus according to claim 10, further comprising an outside air connector disposed in a front portion of the machine room, and configured to allow an air to flow into the machine room.

12. The clothing treatment apparatus according to claim 9, wherein the louver member comprises:

a first louver member; and a second louver member disposed at lower than the first louver member.

13. The clothing treatment apparatus according to claim 12, wherein the first louver member is disposed above the machine room, and wherein the second louver member is disposed front of the machine room.

14. The clothing treatment apparatus according to claim 13, further comprising an outside air connector disposed in a front portion of the machine room, and configured to allow an air to flow into the machine room, wherein the through-channel of the second louver member guides an air to flow to the outside air connector.

15. The clothing treatment apparatus according to claim 12, wherein the first louver member is provided as a pair and is provided on the upper left side of the door inner space and the upper right side of the door inner space, respectively, and wherein the second louver member is provided as a pair and is provided on the lower left side of the door inner space and the lower right side of the door inner space, respectively.

16. The clothing treatment apparatus according to claim 15, wherein the moving member comprises:

a first moving member disposed in the door inner space, configured to move in width direction of the door, and engaged with the pair of first louver members to rotate the pair of the first louver members, respectively; and second moving member disposed in the door inner space, configured to move in width direction of the door, and engaged with the pair of second louver members to rotate the pair of the second louver members, respectively, and wherein the drive assembly comprises:

a first drive assembly provided in the door inner space, and generating a drive force to move the first moving member; and a second drive assembly provided in the door inner space, and generating a drive force to move the second moving member.

* * * * *